US012158296B2

(12) United States Patent
Lee et al.

(10) Patent No.: US 12,158,296 B2
(45) Date of Patent: Dec. 3, 2024

(54) REFRIGERATOR

(71) Applicant: LG ELECTRONICS INC., Seoul (KR)

(72) Inventors: Wookyong Lee, Seoul (KR); Donghoon Lee, Seoul (KR); Seungseob Yeom, Seoul (KR); Chongyoung Park, Seoul (KR); Sunggyun Son, Seoul (KR); Yongjun Bae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/282,310

(22) PCT Filed: Oct. 1, 2019

(86) PCT No.: PCT/KR2019/012886

§ 371 (c)(1),
(2) Date: Apr. 1, 2021

(87) PCT Pub. No.: WO2020/071773

PCT Pub. Date: Apr. 9, 2020

(65) Prior Publication Data

US 2021/0341205 A1 Nov. 4, 2021

(30) Foreign Application Priority Data

Oct. 2, 2018 (KR) ..... 10-2018-0117785
Oct. 2, 2018 (KR) ..... 10-2018-0117819
(Continued)

(51) Int. Cl.
*F25C 1/18* (2006.01)

(52) U.S. Cl.
CPC ..... *F25C 1/18* (2013.01); *F25C 2400/14* (2013.01)

(58) Field of Classification Search
CPC .... F25C 1/18; F25C 2400/14; F25C 2400/10; F25C 1/25; F25C 2600/04; F25C 2700/04; F25C 2700/12; F25C 1/24; F25C 5/08
See application file for complete search history.

(56) References Cited

U.S. PATENT DOCUMENTS 9,234,689 B2 1/2016 Son et al.
9,581,372 B2 2/2017 Lee et al.
(Continued)

FOREIGN PATENT DOCUMENTS

CN 103033011 4/2013
EP 2 549 207 1/2013
(Continued)

OTHER PUBLICATIONS

JP-H09269172-A Translation (Year: 1997).*
(Continued)

*Primary Examiner* — Elizabeth J Martin
*Assistant Examiner* — Dario Antonio Deleon
(74) *Attorney, Agent, or Firm* — KED & ASSOCIATES, LLP

(57) ABSTRACT

A refrigerator includes a storage space, a cooler, a first tray constituting a part of a cell which is the space in which water is phase-changed to ice by the cold, a second tray, which constitutes another part of the cell, a water supply valve to adjust the flow of water to be supplied to the icing cell, a water supply amount detection unit or sensor, and a controller configured to control the supply valve.

16 Claims, 21 Drawing Sheets

(30) Foreign Application Priority Data

| | | |
|---|---|---|
| Oct. 2, 2018 | (KR) | 10-2018-0117821 |
| Oct. 2, 2018 | (KR) | 10-2018-0117822 |
| Nov. 16, 2018 | (KR) | 10-2018-0142117 |
| Sep. 9, 2019 | (KR) | 10-2019-0111420 |

(56) References Cited

U.S. PATENT DOCUMENTS

| | | | | |
|---|---|---|---|---|
| 2004/0025527 | A1* | 2/2004 | Takahashi et al. | F25C 5/08 62/340 |
| 2005/0097903 | A1* | 5/2005 | Jeong et al. | F25C 1/04 62/135 |
| 2006/0090485 | A1* | 5/2006 | Lee et al. | F25C 1/00 62/135 |
| 2010/0319367 | A1* | 4/2010 | Kim et al. | F25C 2400/10 62/71 |
| 2011/0048045 | A1 | 3/2011 | An et al. | |
| 2013/0014536 | A1 | 1/2013 | Son et al. | |
| 2013/0081412 | A1 | 4/2013 | Son et al. | |
| 2013/0152617 | A1* | 6/2013 | Lee et al. | F25C 1/24 62/351 |
| 2013/0167563 | A1 | 7/2013 | Lee et al. | |
| 2013/0327074 | A1* | 12/2013 | Lee et al. | F25C 1/04 62/177 |
| 2013/0327082 | A1 | 12/2013 | Son et al. | |
| 2014/0038060 | A1 | 2/2014 | Abe | |
| 2014/0182325 | A1* | 7/2014 | Lee et al. | F25C 1/04 62/351 |
| 2015/0241102 | A1* | 8/2015 | Yeom et al. | F25D 23/04 62/71 |
| 2016/0138844 | A1* | 1/2016 | Boarman et al. | F25C 1/10 62/66 |
| 2016/0252286 | A1* | 2/2016 | Yoon et al. | F25C 1/18 62/130 |
| 2018/0187941 | A1 | 7/2018 | An et al. | |
| 2018/0231294 | A1 | 8/2018 | Song et al. | |
| 2019/0293335 | A1* | 9/2019 | Hoban et al. | F25C 1/04 |

FOREIGN PATENT DOCUMENTS

| | | | | |
|---|---|---|---|---|
| EP | 2 674 701 | | 12/2013 | |
| EP | 3059526 | | 8/2016 | |
| JP | H01-230969 | | 9/1989 | |
| JP | H05-203299 | | 8/1993 | |
| JP | H05-203302 | | 8/1993 | |
| JP | H06-70543 | | 9/1994 | |
| JP | H09-269172 | | 10/1997 | |
| JP | H09269172 | A * | 10/1997 | F25C 1/10 |
| JP | 2001-289544 | | 10/2001 | |
| JP | 2002-350019 | | 12/2002 | |
| JP | 2003-114072 | | 4/2003 | |
| JP | 2005-326035 | | 11/2005 | |
| JP | 4572833 | | 11/2010 | |
| JP | 2011-064371 | | 3/2011 | |
| JP | 2011-064373 | | 3/2011 | |
| JP | 2011-237077 | | 11/2011 | |
| JP | 6070543 | | 2/2017 | |
| KR | 10-2000-0043137 | | 7/2000 | |
| KR | 10-0301636 | | 11/2001 | |
| KR | 10-2005-0041252 | | 5/2005 | |
| KR | 10-2005-0069319 | | 7/2005 | |
| KR | 10-2005-0096336 | | 10/2005 | |
| KR | 10-2009-0079377 | | 7/2009 | |
| KR | 10-0935746 | | 1/2010 | |
| KR | 10-2010-0054488 | | 5/2010 | |
| KR | 10-2012-0003233 | | 1/2012 | |
| KR | 10-2013-0009332 | | 1/2013 | |
| KR | 10-2013-0009521 | | 1/2013 | |
| KR | 10-2014-0088321 | | 7/2014 | |
| KR | 10-2016-0046551 | | 4/2016 | |
| KR | 10-1643635 | | 7/2016 | |
| KR | 10-1850918 | | 5/2018 | |
| KR | 10-2018-0100752 | | 9/2018 | |
| WO | WO 2009/017284 | | 2/2009 | |

OTHER PUBLICATIONS

International Search Report and Written Opinion dated Jan. 30, 2020 issued in Application No. PCT/KR2019/012886.
Korean Office Action dated May 1, 2023 issued in Application No. 10-2018-0117785.
Korean Office Action dated May 8, 2023 issued in Application No. 10-2018-0117819.
Korean Office Action dated May 14, 2023 issued in Application No. 10-2018-0117821.
Korean Office Action dated May 15, 2023 issued in Application No. 10-2018-0117822.
Chinese Office Action dated May 31, 2022 issued in CN Application No. 201980064193.8.
European Search Report dated Jun. 27, 2022 issued in EP Application No. 19868712.1.
Korean Notice of Allowance dated Nov. 7, 2023 issued in Application No. 10-2018-0117821.
Korean Notice of Allowance dated Jan. 10, 2024 issued in Application No. 10-2018-0142117.
Korean Office Action dated Mar. 12, 2024 issued in Application No. 10-2018-0117822.
Korean Office Action dated Feb. 22, 2024 issued in Application No. 10-2018-0117785.
Korean Notice of Allowance dated Jun. 19, 2024 issued in Application No. 10-2018-0117819.
Korean Notice of Allowance dated Aug. 12, 2024 issued in Application No. 10-2018-0117822.

* cited by examiner

REFRIGERATOR

CROSS-REFERENCE TO RELATED APPLICATIONS

This application is a U.S. National Stage Application under 35 U.S.C. § 371 of PCT Application No. PCT/KR2019/012886, filed Oct. 1, 2019, which claims priority to Korean Patent Application Nos. 10-2018-0117819, filed Oct. 2, 2018, 10-2018-0117821, filed Oct. 2, 2018, 10-2018-0117822, filed Oct. 2, 2018, 10-2018-0117785, filed Oct. 2, 2018, 10-2018-0142117, filed Nov. 16, 2018, and 10-2019-0111420, filed Sep. 9, 2019, whose entire disclosures are hereby incorporated by reference.

TECHNICAL FIELD

The present disclosure relates to a refrigerator.

BACKGROUND ART

In general, refrigerators are home appliances for storing food at a low temperature in a storage space that is covered by a door. The refrigerator may cool the inside of the storage space by using cold air to store the stored food in a refrigerated or frozen state. Generally, an ice maker for making ice is provided in the refrigerator. The ice maker makes ice by cooling water after accommodating the water supplied from a water supply source or a water tank into a tray.

The ice maker separates the made ice from the ice tray in a heating manner or twisting manner.

For example, the ice maker through which water is automatically supplied, and the ice automatically separated may be opened upward so that the mode ice is pumped up.

As described above, the ice made in the ice maker may have at least one flat surface such as crescent or cubic shape.

When the ice has a spherical shape, it is more convenient to use the ice, and also, it is possible to provide different feeling of use to a user. Also, even when the made ice is stored, a contact area between the ice cubes may be minimized to minimize a mat of the ice cubes.

An ice maker is disclosed in Korean Registration No. 10-1850918 (hereinafter, referred to as a "prior art document 1") that is a prior art document.

The ice maker disclosed in the prior art document 1 includes an upper tray in which a plurality of upper cells, each of which has a hemispherical shape, are arranged, and which includes a pair of link guide parts extending upward from both side ends thereof, a lower tray in which a plurality of upper cells, each of which has a hemispherical shape and which is rotatably connected to the upper tray, a rotation shaft connected to rear ends of the lower tray and the upper tray to allow the lower tray to rotate with respect to the upper tray, a pair of links having one end connected to the lower tray and the other end connected to the link guide part, and an upper ejecting pin assembly connected to each of the pair of links in at state in which both ends thereof are inserted into the link guide part and elevated together with the upper ejecting pin assembly.

In the prior art document 1, although the spherical ice is made by the hemispherical upper cell and the hemispherical lower cell, since the ice is made at the same time in the upper and lower cells, bubbles containing water are not completely discharged but are dispersed in the water to make opaque ice.

An ice maker is disclosed in Japanese Patent Laid-Open No. 9-269172 (hereinafter, referred to as a "prior art document 2") that is a prior art document.

The ice maker disclosed in the prior art document 2 includes an ice making plate and a heater for heating a lower portion of water supplied to the ice making plate.

In the case of the ice maker disclosed in the prior art document 2, water on one surface and a bottom surface of an ice making block is heated by the heater in an ice making process. Thus, when solidification proceeds on the surface of the water, and also, convection occurs in the water to make transparent ice.

When growth of the transparent ice proceeds to reduce a volume of the water within the ice making block, the solidification rate is gradually increased, and thus, sufficient convection suitable for the solidification rate may not occur.

Thus, in the case of the prior art document 2, when about ⅔ of water is solidified, a heating amount of heater increases to suppress an increase in the solidification rate.

However, according to the prior art document 2, when only the volume of water is reduced, the heating amount of heater may increase, and thus, it may be difficult to make ice having uniform transparency according to shapes of ice.

DISCLOSURE

Technical Problem

Embodiments provide a refrigerator which is capable of making ice having uniform transparency as a whole regardless of shapes of the ice and a method for manufacturing the same.

Embodiments also provide a refrigerator which is capable of generating ice having the same shape as an ice making cell by accurately supplying water as much as a target water supply amount and a method for manufacturing the same.

Embodiments also provide a refrigerator in which transparency for each unit height of generated ice is uniform and a method for manufacturing the same.

Technical Solution

A refrigerator according to one aspect includes: a storage chamber configured to store food; a cooler configured to supply cold; a first tray configured to define one portion of an ice making cell that is a space in which water is phase-changed into ice by the cold; a second tray configured to define the other portion of the ice making cell, the second tray being in contact with the first tray in an ice making process and being spaced apart from the first tray in an ice separation process; a water supply valve configured to adjust a flow of the water supplied to the ice making cell; a water supply amount detection part configured to detect a water supply amount to the ice making cell; and a controller configured to control the water supply valve.

The controller may control the water supply valve so that water as much as a reference water supply amount is supplied to the ice making cell so as to supply water to the ice making cell at a water supply position of the second tray.

The controller may control the second tray to move to an ice making position after the supply of the water as much as the reference water supply amount is completed and determines whether the water supply amount to the ice making cell reaches a target water supply amount, by the water supply amount detection part.

The controller may control the water supply valve so that the ice making starts when the water supply amount to the ice making cell reaches the target water supply amount, and the second tray moves again to the water supply position to supply water as much as an additional water supply amount less than the reference water supply amount when the water supply amount to the ice making cell does not reach the target water supply amount.

The reference water supply amount may be set differently according to a water supply water pressure determined in the water supply process.

When a reference or predetermined time elapses after the water supply starts, the controller may determine whether the water pressure is less than a reference or predetermined water pressure. When the water pressure is equal to or greater than the reference water pressure, the reference water supply amount may be set as a first reference water supply amount, and when the water pressure is less than the reference water pressure, the reference water supply amount may be set as a second reference water supply amount less than the first reference water supply amount.

When the water pressure is equal to or greater than the reference water pressure, the controller may turn off the water supply valve when the water supply amount reaches the first reference water supply amount, and when the water pressure is less than the reference water pressure, the controller may turn off the water supply valve when the water supply amount reaches the second reference water supply amount.

The additional water supply amount may be set differently according to the water supply water pressure.

The additional water supply amount when the water pressure is low may be greater than the additional water supply amount when the water pressure is high.

After the supply of the water as much as the additional water supply amount is completed, the controller may control the second tray to move to the ice making position and determine whether the water supply amount to the ice making cell reaches the target water supply amount, by the water supply amount detection part.

When the water supply amount to the ice making cell reaches the target water supply amount, the controller may control the ice making to start, and when the water supply amount to the ice making cell does not reach the target water supply amount, the additional water supply as much as the additional water supply amount may be repetitively performed until the water supply amount to the ice making cell reaches the target water supply amount.

The controller may control the second tray to move to an ice separation position in a forward direction so as to take ice out of the ice making cell and then move in a reverse direction after the generation of the ice in the ice making cell is completed.

The controller may control the second tray to move to the water supply position in the reverse direction after the ice separation is completed so as to supply the water.

The water supply amount detection part may include a temperature sensor configured to detect a temperature of the ice making cell.

After the second tray moves to the water supply position after the ice separation is completed, the controller may control the water supply valve so that the water as much as the reference water supply amount is supplied to the ice making cell if a temperature detected by the temperature sensor reaches a water supply start temperature.

After the second tray moves to the water supply position so as to additionally supply water, the controller may control the water supply valve so that the water as much as the additional water supply amount is supplied to the ice making cell if a temperature detected by the temperature sensor reaches a water supply start temperature.

The controller may determine that the water supply amount to the ice making cell reaches the target water supply amount when the temperature detected by the temperature sensor reaches a reference or predetermined temperature that is above zero.

The water supply amount detection part may include a capacitive sensor that outputs different signals according to whether the ice making cell is in contact with water.

When the capacitive sensor is in contact with the water, a first signal may be output, and when the capacitive sensor is not in contact with the water, a second signal may be output. The controller may determine that the water supply amount to the ice making cell reaches the target water supply amount when the first signal is output from the capacitive sensor.

The refrigerator may further include a heater configured to provide heat to the ice making cell.

The controller may control the heater to be turned on in at least partial section while the cooler supplies the cold so that bubbles dissolved in the water within the ice making cell moves from a portion, at which the ice is generated, toward the water that is in a liquid state to generate transparent ice.

The controller may control one or more of cooling power of the cooler, a heating amount of the heater to vary according to a mass per unit height of water within the ice making cell.

A method for controlling a refrigerator according to another aspect relates to a method for controlling a refrigerator, which includes a storage chamber configured to store food, a cooler configured to supply cold, a first tray configured to define one portion of an ice making cell that is a space in which water is phase-changed into ice by the cold, a second tray configured to define the other portion of the ice making cell, the second tray being in contact with the first tray in an ice making process and being spaced apart from the first tray in an ice separation process, a water supply valve configured to adjust a flow of the water supplied to the ice making cell, a water supply amount detection part configured to detect a water supply amount to the ice making cell, and a controller configured to control the water supply valve.

The method for controlling the refrigerator includes: allowing the second tray to move to a water supply position; turning off the water supply valve when water as much as a reference water supply amount is supplied to the ice making cell; allowing the second tray to move to an ice making position after the supply of the water as much as the reference water supply amount is completed; determining whether a water supply amount to the ice making cell reaches a target water supply amount, by the water supply amount detection part; and the controller the ice making to start when the water supply amount to the ice making cell reaches a target water supply amount and the controller controls the water supply valve so that the second tray moves again to the water supply position to supply water as much as an additional water supply amount less than a reference water supply amount when the water supply amount to the ice making cell does not reach the target water supply amount.

When a reference time elapses after the water supply starts, the controller may determine whether the water supply water pressure is less than a reference water pressure. When the water pressure is equal to or greater than the reference water pressure, the reference water supply amount may be set as a first reference water supply amount, and when the water pressure is less than the reference water pressure, the reference water supply amount may be set as a second reference water supply amount less than the first reference water supply amount.

The additional water supply amount when the water pressure is low may be set to be greater than the additional water supply amount when the water pressure is high.

When the second tray moves to the water supply position, the water supply valve may be turned on when a temperature of the ice making cell reaches a reference temperature.

Advantageous Effects

According to the embodiments, since the heater is turned on in at least a portion of the sections while the cooler supplies cold air, the ice making rate may be delayed by the heat of the heater so that the bubbles dissolved in the water inside the ice making cell move toward the liquid water from the portion at which the ice is made, thereby making the transparent ice.

Particularly, according to the embodiments, one or more of the cooling power of the cooler and the heating amount of heater may be controlled to vary according to the mass per unit height of water in the ice making cell to make the ice having the uniform transparency as a whole regardless of the shape of the ice making cell.

In addition, in the case of this embodiment, since the water is accurately supplied as much as the target water supply amount, the ice having the same shape as the ice making cell may be generated.

In addition, in the case of this embodiment, the increase in water supply time may be minimized even when the water pressure is the low water pressure less than the reference water pressure.

Also, the heating amount of transparent ice heater and/or the cooling power of the cooler may vary in response to the change in the heat transfer amount between the water in the ice making cell and the cold air in the storage chamber, thereby making the ice having the uniform transparency as a whole.

MODE FOR INVENTION

Figure 1:
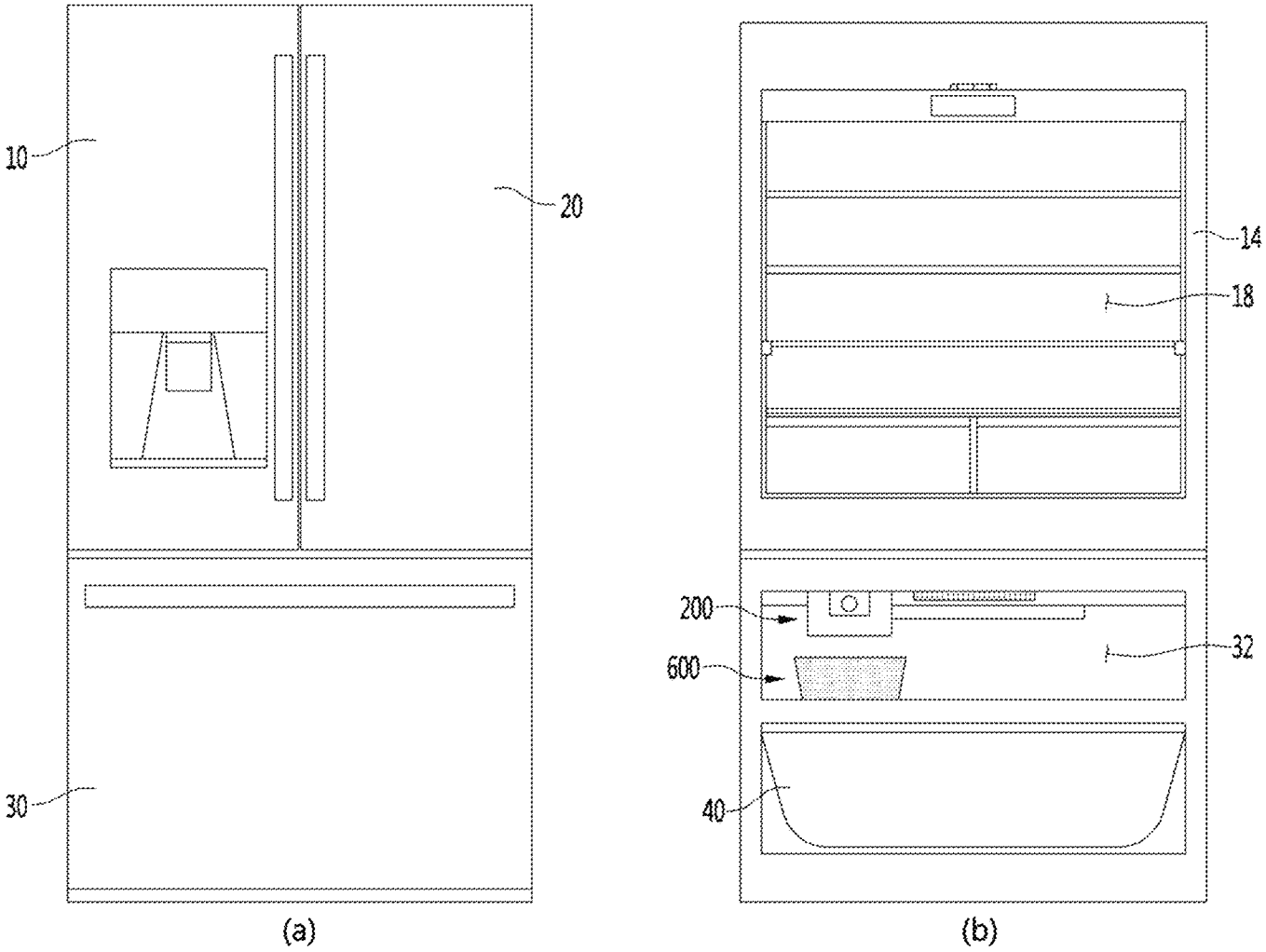
FIG. 1 is a front view of a refrigerator according to an embodiment of the present invention.

Hereinafter, some embodiments of the present invention will be described in detail with reference to the accompanying drawings. Exemplary embodiments of the present invention will be described below in more detail with reference to the accompanying drawings. It is noted that the same or similar components in the drawings are designated by the same reference numerals as far as possible even if they are shown in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

FIG. 1 is a front view of a refrigerator according to an embodiment.

Referring to FIG. 1, a refrigerator according to an embodiment may include a cabinet 14 including a storage chamber and a door that opens and closes the storage chamber.

The storage chamber may include a refrigerating compartment 18 and a freezing compartment 32. The refrigerating compartment 18 is disposed at an upper side, and the freezing compartment 32 is disposed at a lower side. Each of the storage chamber may be opened and closed individually by each door. For another example, the freezing compartment may be disposed at the upper side and the refrigerating compartment may be disposed at the lower side. Alternatively, the freezing compartment may be disposed at one side of left and right sides, and the refrigerating compartment may be disposed at the other side.

The freezing compartment 32 may be divided into an upper space and a lower space, and a drawer 40 capable of being withdrawn from and inserted into the lower space may be provided in the lower space.

The door may include a plurality of doors 10, 20, 30 for opening and closing the refrigerating compartment 18 and the freezing compartment 32. The plurality of doors 10, 20, and 30 may include some or all of the doors 10 and 20 for opening and closing the storage chamber in a rotatable manner and the door 30 for opening and closing the storage chamber in a sliding manner. The freezing compartment 32 may be provided to be separated into two spaces even though the freezing compartment 32 is opened and closed by one door 30.

In this embodiment, the freezing compartment 32 may be referred to as a first storage chamber, and the refrigerating compartment 18 may be referred to as a second storage chamber.

The freezing compartment 32 may be provided with an ice maker 200 capable of making ice. The ice maker 200 may be disposed, for example, in an upper space of the freezing compartment 32.

An ice bin 600 in which the ice made by the ice maker 200 drops to be stored may be disposed below the ice maker 200. A user may take out the ice bin 600 from the freezing compartment 32 to use the ice stored in the ice bin 600. The ice bin 600 may be mounted on an upper side of a horizontal wall that partitions an upper space and a lower space of the freezing compartment 32 from each other.

Although not shown, the cabinet 14 is provided with a duct supplying cold air to the ice maker 200. The duct guides the cold air heat-exchanged with a refrigerant flowing through the evaporator to the ice maker 200. For example, the duct may be disposed behind the cabinet 14 to discharge the cold air toward a front side of the cabinet 14. The ice maker 200 may be disposed at a front side of the duct. Although not limited, a discharge hole of the duct may be provided in one or more of a rear wall and an upper wall of the freezing compartment 32.

Although the above-described ice maker 200 is provided in the freezing compartment 32, a space in which the ice maker 200 is disposed is not limited to the freezing compartment 32. For example, the ice maker 200 may be disposed in various spaces as long as the ice maker 200 receives the cold air.

Figure 2:
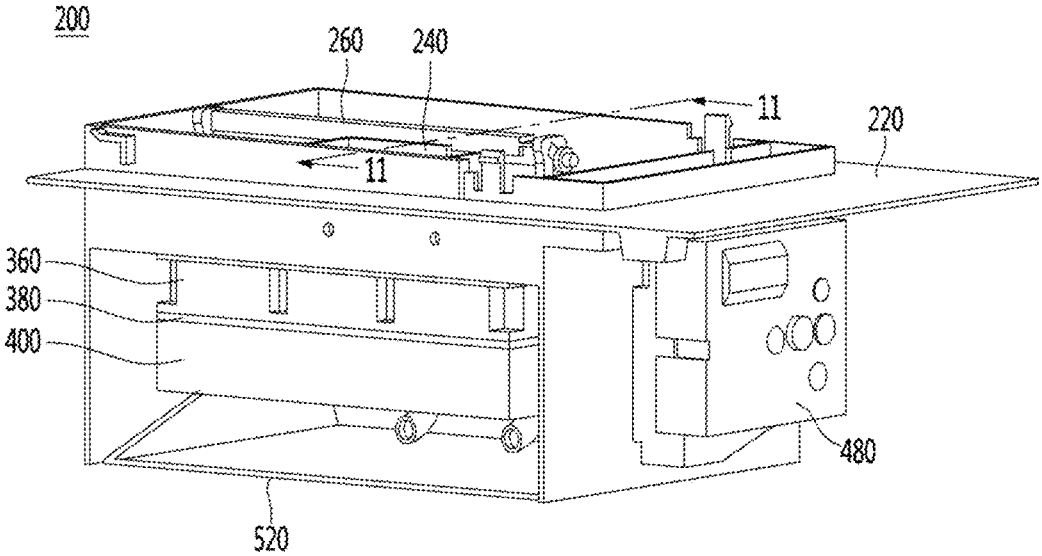
FIG. 2 is a perspective view of an ice maker according to an embodiment of the present invention.
Figure 3:
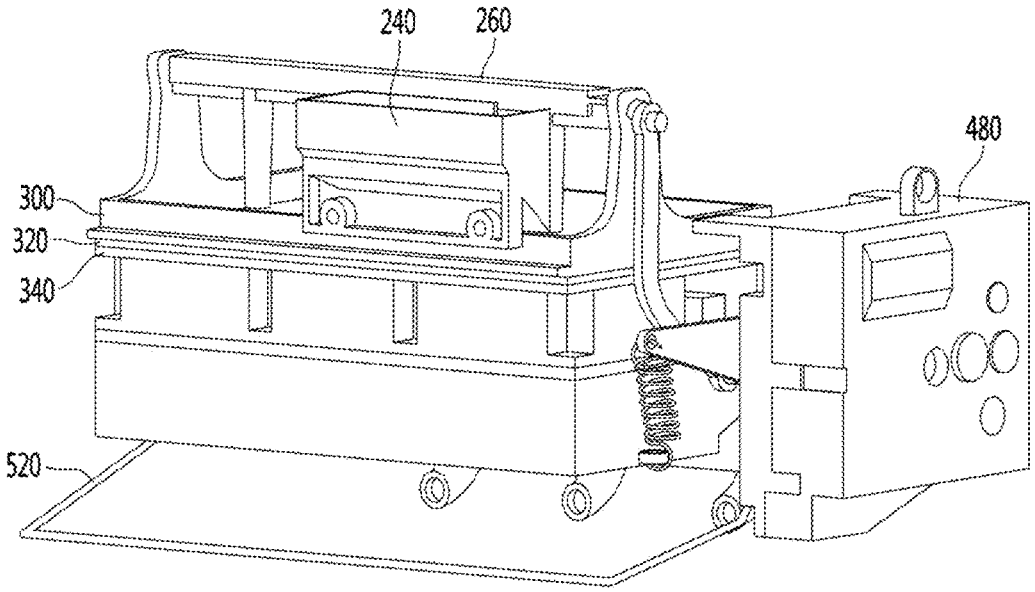
FIG. 3 is a perspective view illustrating a state in which a bracket is removed from the ice maker of FIG. 2.
Figure 4:
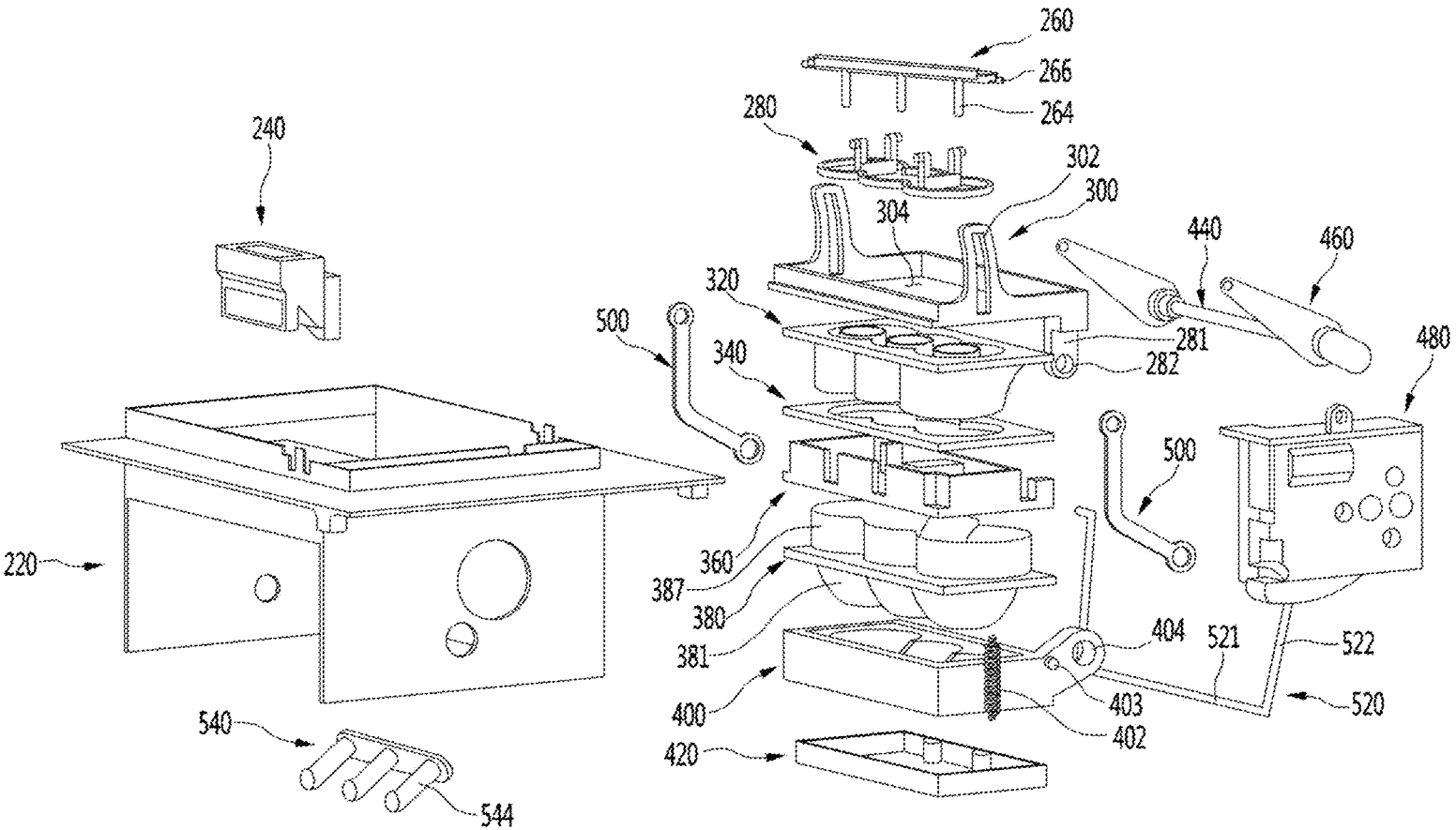
FIG. 4 is an exploded perspective view of the ice maker according to an embodiment of the present invention.

FIG. 2 is a perspective view of the ice maker according to an embodiment, FIG. 3 is a perspective view illustrating a state in which the bracket is removed from the ice maker of FIG. 2, and FIG. 4 is an exploded perspective view of the ice maker according to an embodiment.

Referring to FIGS. 2 to 4, each component of the ice maker 200 may be provided inside or outside the bracket 220, and thus, the ice maker 200 may constitute one assembly.

The bracket 220 may be installed at, for example, the upper wall of the freezing compartment 32. The water supply part or liquid supply 240 may be installed on an upper side of an inner surface of the bracket 220. The water supply part 240 may be provided with an opening in each of an upper side and a lower side to guide water, which is supplied to an upper side of the water supply part 240, to a lower side of the water supply part 240. The upper opening of the water supply part 240 may be greater than the lower opening to limit a discharge range of water guided downward through the water supply part 240. A water supply pipe through which water is supplied may be installed to the upper side of the water supply part 240. The water supplied to the water supply part 240 may move downward. The water supply part 240 may prevent the water discharged from the water supply pipe from dropping from a high position, thereby preventing the water from splashing. Since the water supply part 240 is disposed below the water supply pipe, the water may be guided downward without splashing up to the water supply part 240, and an amount of splashing water may be reduced even if the water moves downward due to the lowered height.

The ice maker 200 may include a first tray assembly and a second tray assembly.

The first tray assembly may include a first tray 320, a first tray case, or all of the first tray 320 and a first tray case. The second tray assembly may include a second tray 380, a second tray case, or all of the second tray 380 and a second tray case.

The bracket 220 may define at least a portion of a space that accommodates the first tray assembly and the second tray assembly.

The ice maker 200 may include an ice making cell 320*a* (see FIG. 11) in which water is phase-changed into ice by the cold air.

The first tray 320 may form at least a portion of the ice making cell 320*a*. The second tray 380 may form the other portion of the ice making cell 320*a*.

The second tray 380 may be disposed to be relatively movable with respect to the first tray 320. The second tray 380 may linearly rotate or rotate. Hereinafter, the rotation of the second tray 380 will be described as an example.

For example, in an ice making process, the second tray 380 may move with respect to the first tray 320 so that the first tray 320 and the second tray 380 contact each other. When the first tray 320 and the second tray 380 are in contact with each other, the complete ice making cell see 320*a* may be defined.

On the other hand, the second tray 380 may move with respect to the first tray 320 during the ice making process after the ice making is completed, and the second tray 380 may be spaced apart from the first tray 320.

In this embodiment, the first tray 320 and the second tray 380 may be arranged in a vertical direction in a state in which the ice making cell 320*a* is defined. Accordingly, the first tray 320 may be referred to as an upper tray, and the second tray 380 may be referred to as a lower tray.

A plurality of ice making cells 320*a* may be defined by the first tray 320 and the second tray 380.

When water is cooled by cold air while water is supplied to the ice making cell 320*a*, ice having the same or similar shape as that of the ice making cell 320*a* may be made. In this embodiment, for example, the ice making cell 320*a* may be provided in a spherical shape or a shape similar to a spherical shape. The ice making cell 320*a* may have a rectangular parallelepiped shape or a polygonal shape.

For example, the first tray case may include the first tray supporter 340 and the first tray cover 300. The first tray supporter 340 and the first tray cover 300 may be integrally provided or coupled to each other with each other after being manufactured in separate configurations. For example, at least a portion of the first tray cover 300 may be disposed above the first tray 320. At least a portion of the first tray supporter 340 may be disposed under the first tray 320.

The first tray cover 300 may be manufactured as a separate part from the bracket 220 and then may be coupled to the bracket 220 or integrally formed with the bracket 220. That is, the first tray case may include the bracket 220.

The ice maker 200 may further include a first heater case 280. An ice separation heater 290 may be installed in the first heater case 280. The first heater case 280 may be integrally formed with the first tray cover 300 or may be separately provided to be coupled to the first tray cover 300. The ice separation heater 290 may be disposed at a position adjacent to the first tray 320. For example, the ice separation heater 290 may be a wire-type heater. For example, the ice separation heater 290 may be installed to contact the second tray 320 or may be disposed at a position spaced a predetermined distance from the second tray 380. In some cases, the ice separation heater 290 may supply heat to the first tray 320, and the heat supplied to the first tray 320 may be transferred to the ice making cell 320*a*.

The ice maker 200 may include a first pusher 260 separating the ice during an ice separation process. The first pusher 260 may receive power of the driver 480 to be described later.

The first tray cover 300 may be provided with a guide slot 302 guiding movement of the first pusher 260. The guide slot 302 may be provided in a portion extending upward from the first tray cover 300. A guide protrusion 266 of the first pusher 260 may be inserted into the guide slot 302. Thus, the guide protrusion 266 may be guided along the guide slot 302.

The first pusher 260 may include at least one pushing bar 264. For example, the first pusher 260 may include a pushing bar 264 provided with the same number as the number of ice making cells 320*a*, but is not limited thereto. The pushing bar 264 may push out the ice disposed in the ice making cell 320*a* during the ice separation process. For example, the pushing bar 264 may be inserted into the ice making cell 320*a* through the first tray cover 300. Therefore, the first tray case 300 may be provided with an opening 304 through which a portion of the first pusher 260 passes.

The guide protrusion 266 of the first pusher 260 may be coupled to the pusher link 500. In this case, the guide protrusion 266 may be coupled to the pusher link 500 so as to be rotatable. Therefore, when the pusher link 500 moves, the first pusher 260 may also move along the guide slot 302.

The second tray case may include, for example, a second tray cover 360 and a second tray supporter 400. The second tray cover 360 and the second tray supporter 400 may be integrally formed or coupled to each other with each other after being manufactured in separate configurations. For example, at least a portion of the second tray cover 360 may be disposed above the second tray 380. At least a portion of the second tray supporter 400 may be disposed below the second tray 380. The second tray supporter 400 may be disposed at a lower side of the second tray to support the second tray 380. For example, at least a portion of the wall defining a second cell 381*a* the second tray 380 may be supported by the second tray supporter 400.

A spring 402 may be connected to one side of the second tray supporter 400. The spring 402 may provide elastic force to the second tray supporter 400 to maintain a state in which the second tray 380 contacts the first tray 320.

The second tray 380 may include a circumferential wall 387 surrounding a portion of the first tray 320 in a state of contacting the first tray 320. The second tray cover 360 may cover the circumferential wall 387.

The ice maker 200 may further include a second heater case 420. A transparent ice heater 430 may be installed in the second heater case 420. The second heater case 420 may be integrally formed with the second tray supporter 400 or may be separately provided to be coupled to the second tray supporter 400.

The transparent ice heater 430 will be described in detail.

The controller 800 according to this embodiment may control the transparent ice heater 430 so that heat is supplied to the ice making cell 320*a* in at least partial section while cold air is supplied to the ice making cell 320*a* to make the transparent ice.

An ice making rate may be delayed so that bubbles dissolved in water within the ice making cell 320*a* may move from a portion at which ice is made toward liquid water by the heat of the transparent ice heater 430, thereby making transparent ice in the ice maker 200. That is, the bubbles dissolved in water may be induced to escape to the outside of the ice making cell 320*a* or to be collected into a predetermined position in the ice making cell 320*a*.

When a cold air supply part 900 to be described later supplies cold air to the ice making cell 320*a*, if the ice making rate is high, the bubbles dissolved in the water inside the ice making cell 320*a* may be frozen without moving from the portion at which the ice is made to the liquid water, and thus, transparency of the ice may be reduced.

On the contrary, when the cold air supply part 900 supplies the cold air to the ice making cell 320*a*, if the ice making rate is low, the above limitation may be solved to increase in transparency of the ice. However, there is a limitation in which an ice making time increases.

Accordingly, the transparent ice heater 430 may be disposed at one side of the ice making cell 320*a* so that the heater locally supplies heat to the ice making cell 320*a*, thereby increasing in transparency of the made ice while reducing the ice making time.

When the transparent ice heater 430 is disposed on one side of the ice making cell 320*a*, the transparent ice heater 430 may be made of a material having thermal conductivity less than that of the metal to prevent heat of the transparent ice heater 430 from being easily transferred to the other side of the ice making cell 320*a*.

At least one of the first tray 320 and the second tray 380 may be made of a resin including plastic so that the ice attached to the trays 320 and 380 is separated in the ice making process.

At least one of the first tray 320 or the second tray 380 may be made of a flexible or soft material so that the tray deformed by the pushers 260 and 540 is easily restored to its original shape in the ice separation process.

The transparent ice heater 430 may be disposed at a position adjacent to the second tray 380. For example, the transparent ice heater 430 may be a wire-type heater. For example, the transparent ice heater 430 may be installed to contact the second tray 380 or may be disposed at a position spaced a predetermined distance from the second tray 380. For another example, the second heater case 420 may not be separately provided, but the transparent heater 430 may be installed on the second tray supporter 400. In some cases, the transparent ice heater 430 may supply heat to the second tray 380, and the heat supplied to the second tray 380 may be transferred to the ice making cell 320*a*.

The ice maker 200 may further include a driver 480 that provides driving force. The second tray 380 may relatively move with respect to the first tray 320 by receiving the driving force of the driver 480. The first pusher 260 may move by receiving the driving force of the driving force 480.

A through-hole 282 may be defined in an extension part 281 extending downward in one side of the first tray supporter 300. A through-hole 404 may be defined in the extension part 403 extending in one side of the second tray supporter 400. The ice maker 200 may further include a shaft 440 that passes through the through-holes 282 and 404 together.

A rotation arm 460 may be provided at each of both ends of the shaft 440. The shaft 440 may rotate by receiving rotational force from the driver 480. Alternatively, the rotation arm may be connected to the driver 480 to rotate by receiving rotational force from the driver 480. In this case, the shaft 440 may be connected to the rotation arm, which is not connected to the driver 480, of the pair of rotation arms 460 to transmit the rotational force.

One end of the rotation arm 460 may be connected to one end of the spring 402, and thus, a position of the rotation arm 460 may move to an initial value by restoring force when the spring 402 is tensioned.

The driver 480 may include a motor and a plurality of gears.

A full ice detection lever 520 may be connected to the driver 480. The full ice detection lever 520 may also rotate by the rotational force provided by the driver 480.

The full ice detection lever 520 may have a E shape as a whole. For example, the full ice detection lever 520 may include a first portion 521 and a pair of second portions 522 extending in a direction crossing the first portion 521 at both ends of the first portion 521. One of the pair of second portions 522 may be coupled to the driver 480, and the other may be coupled to the bracket 220 or the first tray supporter 300.

The full ice detection lever 520 may rotate to detect ice stored in the ice bin 600.

The driver 480 may further include a cam that rotates by the rotational power of the motor.

The ice maker 200 may further include a sensor that senses the rotation of the cam.

For example, the cam is provided with a magnet, and the sensor may be a hall sensor detecting magnetism of the magnet during the rotation of the cam. The sensor may output first and second signals that are different outputs according to whether the sensor senses a magnet. One of the first signal and the second signal may be a high signal, and the other may be a low signal.

The controller 800 to be described later may determine a position of the second tray 380 based on the type and pattern of the signal outputted from the sensor. That is, since the second tray 380 and the cam rotate by the motor, the position of the second tray 380 may be indirectly determined based on a detection signal of the magnet provided in the cam.

For example, a water supply position and an ice making position, which will be described later, may be distinguished and determined based on the signals outputted from the sensor.

The ice maker 200 may further include a second pusher 540. The second pusher 540 may be installed on the bracket 220. The second pusher 540 may include at least one pushing bar 544. For example, the second pusher 540 may include a pushing bar 544 provided with the same number as the number of ice making cells 320*a*, but is not limited thereto. The pushing bar 544 may push the ice disposed in the ice making cell 320*a*. For example, the pushing bar 544 may pass through the second tray supporter 400 to contact the second tray 380 defining the ice making cell 320*a* and then press the contacting second tray 380. Therefore, the second tray supporter 400 may be provided with a lower opening 406*b* (see FIG. 10) through which a portion of the second pusher 540 passes.

The first tray supporter 300 may be rotatably coupled to the second tray supporter 400 with respect to the second tray supporter 400 and then be disposed to change in angle about the shaft 440.

In this embodiment, the second tray 380 may be made of a non-metal material. For example, when the second tray 380 is pressed by the second pusher 540, the second tray 380 may be made of a flexible or soft material which is deformable. Although not limited, the second tray 380 may be made of, for example, a silicon material.

Therefore, while the second tray 380 is deformed while the second tray 380 is pressed by the second pusher 540, pressing force of the second pusher 540 may be transmitted to ice. The ice and the second tray 380 may be separated from each other by the pressing force of the second pusher 540.

When the second tray 380 is made of the non-metal material and the flexible or soft material, the coupling force or attaching force between the ice and the second tray 380 may be reduced, and thus, the ice may be easily separated from the second tray 380.

Also, if the second tray 380 is made of the non-metallic material and the flexible or soft material, after the shape of the second tray 380 is deformed by the second pusher 540, when the pressing force of the second pusher 540 is removed, the second tray 380 may be easily restored to its original shape.

For another example, the first tray 320 may be made of a metal material. In this case, since the coupling force or the attaching force between the first tray 320 and the ice is strong, the ice maker 200 according to this embodiment may include at least one of the ice separation heater 290 or the first pusher 260.

For another example, the first tray 320 may be made of a non-metallic material. When the first tray 320 is made of the non-metallic material, the ice maker 200 may include only one of the ice separation heater 290 and the first pusher 260. Alternatively, the ice maker 200 may not include the ice separation heater 290 and the first pusher 260. Although not limited, the first tray 320 may be made of, for example, a silicon material. That is, the first tray 320 and the second tray 380 may be made of the same material.

When the first tray 320 and the second tray 380 are made of the same material, the first tray 320 and the second tray 380 may have different hardness to maintain sealing performance at the contact portion between the first tray 320 and the second tray 380.

In this embodiment, since the second tray 380 is pressed by the second pusher 540 to be deformed, the second tray 380 may have hardness less than that of the first tray 320 to facilitate the deformation of the second tray 380.

Figure 5:
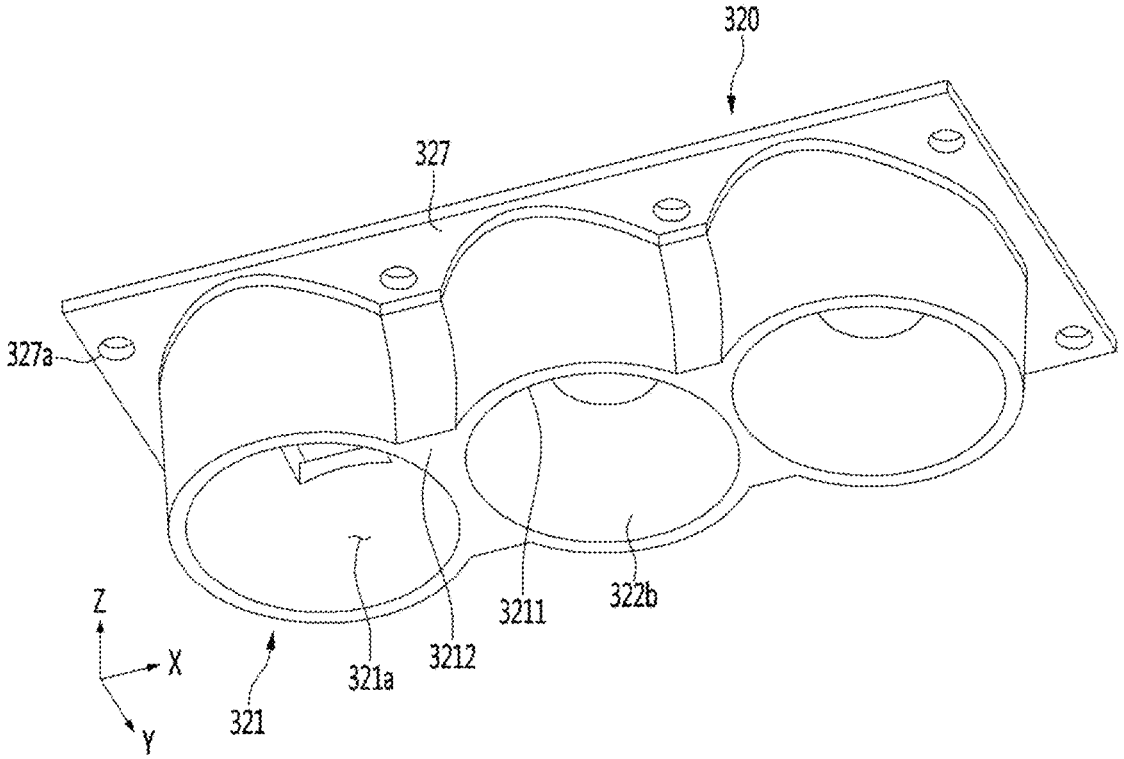
FIG. 5 is a perspective view of a first tray when viewed from a lower side according to an embodiment of the present invention.
Figure 6:
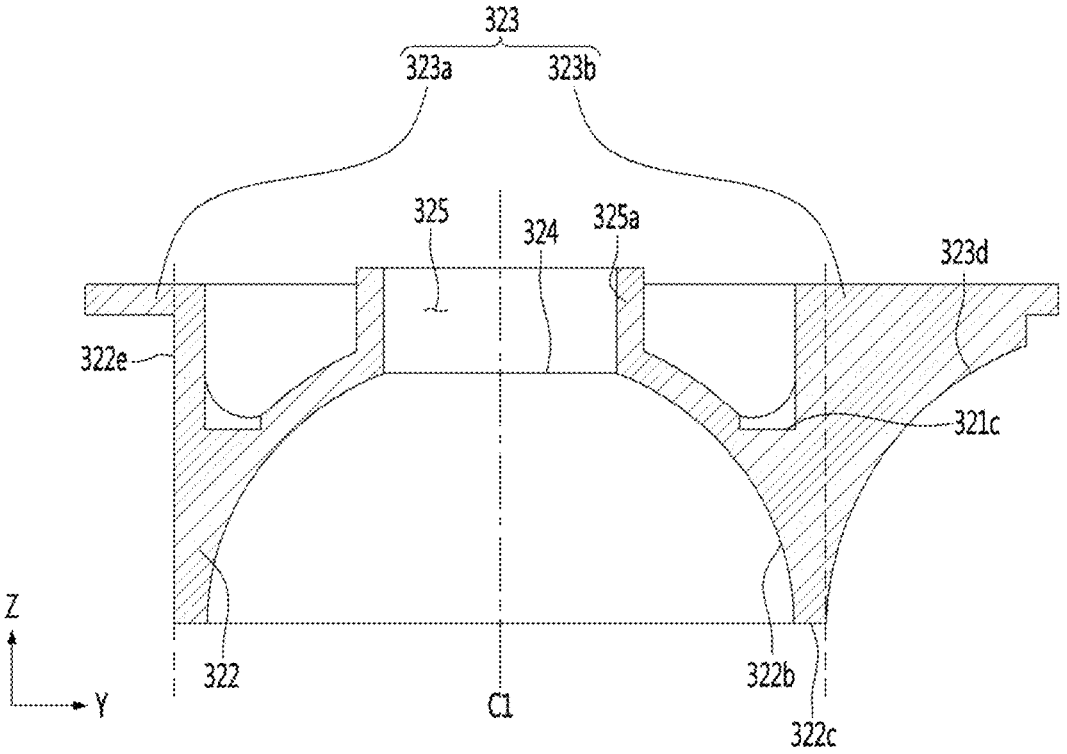
FIG. 6 is a cross-sectional view of the first tray according to an embodiment of the present invention.

FIG. 5 is a perspective view of the first tray when viewed from a lower side according to an embodiment of the present invention, and FIG. 6 is a cross-sectional view of the first tray according to an embodiment of the present invention.

Referring to FIGS. 5 and 6, the first tray 320 may define a first cell 321*a* that is a portion of the ice making cell 320*a*.

The first tray 320 may include a first tray wall 321 defining a portion of the ice making cell 320*a*.

For example, the first tray 320 may define a plurality of first cells 321*a*. For example, the plurality of first cells 321*a* may be arranged in a line. The plurality of first cells 321*a* may be arranged in an X-axis direction in FIG. 5. For example, the first tray wall 321 may define the plurality of first cells 321*a*.

The first tray wall 321 may include a plurality of first cell walls 3211 that respectively define the plurality of first cells

321*a*, and a connection wall 3212 connecting the plurality of first cell walls 3211 to each other. The first tray wall 321 may be a wall extending in the vertical direction.

The first tray 320 may include an opening 324. The opening 324 may communicate with the first cell 321*a*. The opening 324 may allow the cold air to be supplied to the first cell 321*a*. The opening 324 may allow water for making ice to be supplied to the first cell 321*a*. The opening 324 may provide a passage through which a portion of the first pusher 260 passes. For example, in the ice separation process, a portion of the first pusher 260 may be inserted into the ice making cell 320*a* through the opening 324.

The first tray 320 may include a plurality of openings 324 corresponding to the plurality of first cells 321*a*. One of the plurality of openings 324 324*a* may provide a passage of the cold air, a passage of the water, and a passage of the first pusher 260. In the ice making process, the bubbles may escape through the opening 324.

The first tray 320 may further include an auxiliary storage chamber 325 communicating with the ice making cell 320*a*. For example, the auxiliary storage chamber 325 may store water overflowed from the ice making cell 320*a*. The ice expanded in a process of phase-changing the supplied water may be disposed in the auxiliary storage chamber 325. That is, the expanded ice may pass through the opening 324 and be disposed in the auxiliary storage chamber 325. The auxiliary storage chamber 325 may be defined by a storage chamber wall 325*a*. The storage chamber wall 325*a* may extend upwardly around the opening 324. The storage chamber wall 325*a* may have a cylindrical shape or a polygonal shape.

Substantially, the first pusher 260 may pass through the opening 324 after passing through the storage chamber wall 325*a*. The storage chamber wall 325*a* may define the auxiliary storage chamber 325 and also reduce deformation of the periphery of the opening 324 in the process in which the first pusher 260 passes through the opening 324 during the ice separation process.

The first tray 320 may include a first contact surface 322*c* contacting the second tray 380.

The first tray 320 may further include a first extension wall 327 extending in the horizontal direction from the first tray wall 321. For example, the first extension wall 327 may extend in the horizontal direction around an upper end of the first extension wall 327. One or more first coupling holes 327*a* may be provided in the first extension wall 327. Although not limited, the plurality of first coupling holes 327*a* may be arranged in one or more axes of the X axis and the Y axis.

In this specification, the "central line" is a line passing through a volume center of the ice making cell 320*a* or a center of gravity of water or ice in the ice making cell 320*a* regardless of the axial direction.

Referring to FIG. 6, the first tray 320 may include a first portion 322 that defines a portion of the ice making cell 320*a*. For example, the first portion 322 may be a portion of the first tray wall 321.

The first portion 322 may include a first cell surface 322*b* (or an outer circumferential surface) defining the first cell 321*a*. The first portion 322 may include the opening 324. Also, the first portion 322 may include a heater accommodation part 321*c*. The ice separation heater may be accommodated in the heater accommodation part 321*c*. The first portion 322 may be divided into a first region defined close to the transparent ice heater 430 and a second region defined far from the transparent ice heater 430 in the Z axis direction.

The first region may include the first contact surface 322*c*, and the second region may include the opening 324.

The first portion 322 may be defined as an area between two dotted lines in FIG. 6.

In a deformation resistance degree from the center of the ice making cell 320*a* in the circumferential direction, at least a portion of the upper portion of the first portion 322 is greater than at least a portion of the lower portion. The deformation resistance degree of at least a portion of the upper portion of the first portion 322 is greater than that of the lowermost end of the first portion 322.

The upper and lower portions of the first portion 322 may be divided based on an extension direction of a center line C1 (or a vertical center line) in the Z-axis direction in the ice making cell 320*a*. The lowermost end of the first portion 322 is the first contact surface 322*c* contacting the second tray 380. The first tray 320 may further include a second portion 323 extending from a predetermined point of the first portion 322. The predetermined point of the first portion 322 may be one end of the first portion 322. Alternatively, the predetermined point of the first portion 322 may be one point of the first contact surface 322*c*.

A portion of the second portion 323 may be defined by the first tray wall 321, and the other portion of the second portion 323 may be defined by the first extension wall 327. At least a portion of the second portion 323 may extend in a direction away from the transparent ice heater 430. At least a portion of the second portion 323 may extend upward from the first contact surface 322*c*. At least a portion of the second portion 323 may extend in a direction away from the central line C1. For example, the second portion 323 may extend in both directions along the Y axis from the central line C1. The second portion 323 may be disposed at a position higher than or equal to the uppermost end of the ice making cell 320*a*. The uppermost end of the ice making cell 320*a* is a portion at which the opening 324 is defined. The second portion 323 may include a first extension part 323*a* and a second extension part 323*b*, which extend in different directions with respect to the central line C1.

The first tray wall 321 may include one portion of the second extension part 323*b* of each of the first portion 322 and the second portion 323. The first extension wall 327 may include the other portion of each of the first extension part 323*a* and the second extension part 323*b*.

Referring to FIG. 6, the first extension part 323*a* may be disposed at the left side with respect to the central line C1, and the second extension part 323*b* may be disposed at the right side with respect to the central line C1.

The first extension part 323*a* and the second extension part 323*b* may have different shapes based on the central line C1. The first extension part 323*a* and the second extension part 323*b* may be provided in an asymmetrical shape with respect to the central line C1. A length of the second extension part 323*b* in the Y-axis direction may be greater than that of the first extension part 323*a*. Therefore, while the ice is made and grown from the upper side in the ice making process, the deformation resistance degree of the second extension part 323*b* may increase. The second extension part 323*b* may be disposed closer to the shaft 440 that provides a center of rotation of the second tray assembly than the first extension part 323*a*.

In this embodiment, since the length of the second extension part 323*b* in the Y-axis direction is greater than that of the first extension part 323*a*, the second tray assembly including the second tray 380 contacting the first tray 320 may increase in radius of rotation. When the rotation radius of the second tray assembly increases, centrifugal force of the second tray assembly may increase. Thus, in the ice separation process, separating force for separating the ice from the second tray assembly may increase to improve ice separation performance.

The thickness of the first tray wall 321 is minimized at a side of the first contact surface 322*c*. At least a portion of the first tray wall 321 may increase in thickness from the first contact surface 322*c* toward the upper side. Since the thickness of the first tray wall 321 increases upward, a portion of the first portion 322 defined by the first tray wall 321 serves as a deformation resistance reinforcement part (or a first deformation resistance reinforcement part). In addition, the second portion 323 extending outward from the first portion 322 also serves as the deformation resistance reinforcement part (or a second deformation resistance reinforcement part).

The internal deformed reinforcement part may be directly or indirectly supported by the bracket 220. For example, the deformation resistance reinforcement part may be connected to the first tray case and supported by the bracket 220. Here, a portion of the first tray case, which is in contact with the deformation resistance reinforcement portion of the first tray 320, may also serve as the deformation resistance reinforcement portion. The deformation resistance reinforcement part may be configured so that ice is generated from the first cell 321*a* formed by the first tray 320 to the second cell 381*a* formed by the second tray 380 during the ice making process.

Figure 7:
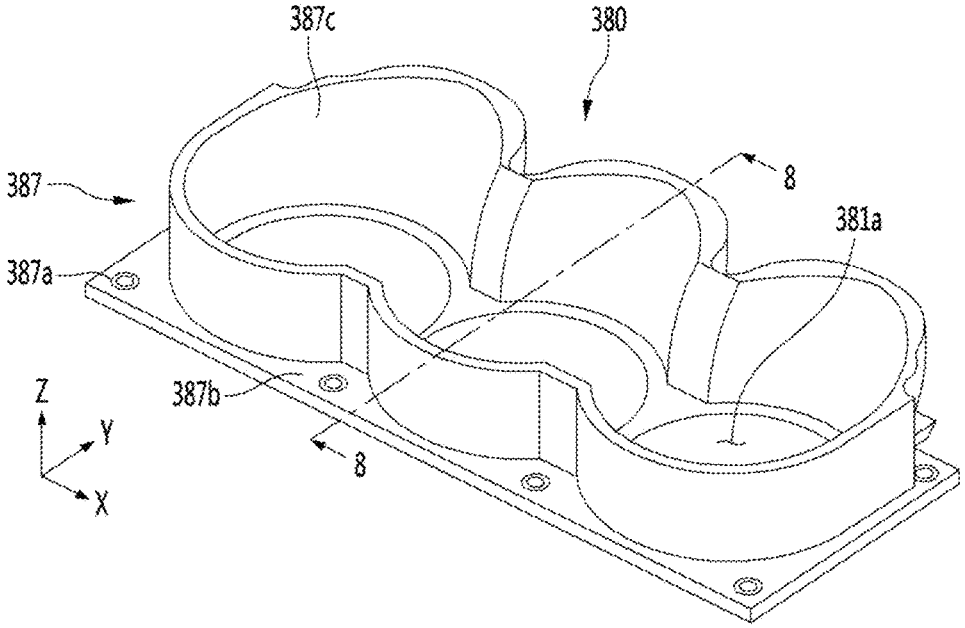
FIG. 7 is a perspective view of a second tray when viewed from an upper side according to an embodiment of the present invention.
Figure 8:
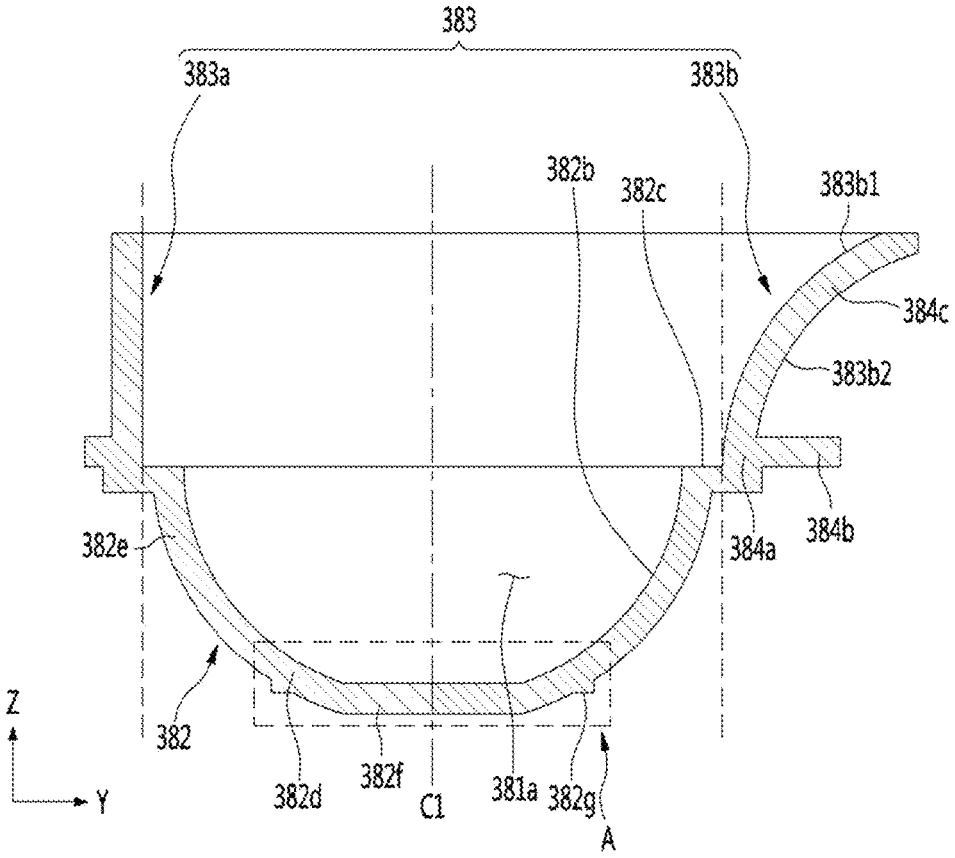
FIG. 8 is a cross-sectional view taken along line 8-8 of FIG. 7.

FIG. 7 is a perspective view of the second tray when viewed from an upper side according to an embodiment of the present invention, and FIG. 8 is a cross-sectional view taken along line 8-8 of FIG. 7.

Referring to FIGS. 7 and 8, the second tray 380 may define a second cell 381*a* which is another portion of the ice making cell 320*a*. The second tray 380 may include a second tray wall 381 defining a portion of the ice making cell 320*a*. For example, the second tray 380 may define a plurality of second cells 381*a*. For example, the plurality of second cells 381*a* may be arranged in a line. Referring to FIG. 7, the plurality of second cells 381*a* may be arranged in the X-axis direction. For example, the second tray wall 381 may define the plurality of second cells 381*a*.

The second tray 380 may include a circumferential wall 387 extending along a circumference of an upper end of the second tray wall 381. The circumferential wall 387 may be formed integrally with the second tray wall 381 and may extend from an upper end of the second tray wall 381.

For another example, the circumferential wall 387 may be provided separately from the second tray wall 381 and disposed around the upper end of the second tray wall 381. In this case, the circumferential wall 387 may be in contact with the second tray wall 381 or be spaced apart from the second tray wall 381. In any case, the circumferential wall 387 may surround at least a portion of the first tray 320.

If the second tray 380 includes the circumferential wall 387, the second tray 380 may surround the first tray 320. When the second tray 380 and the circumferential wall 387 are provided separately from each other, the circumferential wall 387 may be integrally formed with the second tray case or may be coupled to the second tray case. For example, one second tray wall may define a plurality of second cells 381*a*, and one continuous circumferential wall 387 may surround the first tray 250.

The circumferential wall 387 may include a first extension wall 387*b* extending in the horizontal direction and a second extension wall 387*c* extending in the vertical direction. The first extension wall 387*b* may be provided with one or more second coupling holes 387*a* to be coupled to the second tray case. The plurality of second coupling holes 387*a* may be arranged in at least one axis of the X axis or the Y axis.

The second tray 380 may include a second contact surface 382*c* contacting the first contact surface 322*c* of the first tray 320. The first contact surface 322*c* and the second contact surface 382*c* may be horizontal planes. Each of the first contact surface 322*c* and the second contact surface 382*c* may be provided in a ring shape. When the ice making cell 320*a* has a spherical shape, each of the first contact surface 322*c* and the second contact surface 382*c* may have a circular ring shape.

The second tray 380 may include a first portion 382 that defines at least a portion of the ice making cell 320*a*. For example, the first portion 382 may be a portion or the whole of the second tray wall 381.

In this specification, the first portion 322 of the first tray 320 may be referred to as a third portion so as to be distinguished from the first portion 382 of the second tray 380. Also, the second portion 323 of the first tray 320 may be referred to as a fourth portion so as to be distinguished from the second portion 383 of the second tray 380.

The first portion 382 may include a second cell surface 382*b* (or an outer circumferential surface) defining the second cell 381*a* of the ice making cell 320*a*. The first portion 382 may be defined as an area between two dotted lines in FIG. 10. The uppermost end of the first portion 382 is the second contact surface 382*c* contacting the first tray 320.

The second tray 380 may further include a second portion 383. The second portion 383 may reduce transfer of heat, which is transferred from the transparent ice heater 430 to the second tray 380, to the ice making cell 320*a* defined by the first tray 320. That is, the second portion 383 serves to allow the heat conduction path to move in a direction away from the first cell 321*a*. The second portion 383 may be a portion or the whole of the circumferential wall 387. The second portion 383 may extend from a predetermined point of the first portion 382. In the following description, for example, the second portion 383 is connected to the first portion 382.

The predetermined point of the first portion 382 may be one end of the first portion 382. Alternatively, the predetermined point of the first portion 382 may be one point of the second contact surface 382*c*. The second portion 383 may include the other end that does not contact one end contacting the predetermined point of the first portion 382. The other end of the second portion 383 may be disposed farther from the first cell 321*a* than one end of the second portion 383.

At least a portion of the second portion 383 may extend in a direction away from the first cell 321*a*. At least a portion of the second portion 383 may extend in a direction away from the second cell 381*a*. At least a portion of the second portion 383 may extend upward from the second contact surface 382*c*. At least a portion of the second portion 383 may extend horizontally in a direction away from the central line C1. A center of curvature of at least a portion of the second portion 383 may coincide with a center of rotation of the shaft 440 which is connected to the driver 480 to rotate.

The second portion 383 may include a first part 384*a* extending from one point of the first portion 382. The second portion 383 may further include a second part 384*b* extending in the same direction as the extending direction with the first part 384*a*. Alternatively, the second portion 383 may further include a second part 384*b* extending in a direction different from the extending direction of the first part 384*a*.

Alternatively, the second portion 383 may further include a second part 384*b* and a third part 384*c* branched from the first part 384*a*.

For example, the first part 384*a* may extend in the horizontal direction from the first portion 382. A portion of the first part 384*a* may be disposed at a position higher than that of the second contact surface 382*c*. That is, the first part 384*a* may include a horizontally extension part and a vertically extension part. The first part 384*a* may further include a portion extending from the predetermined point in a vertical direction. A length of the second extension part 323*b* in the Y-axis direction may be greater than that of the first extension part 323*a*.

The extension direction of at least a portion of the first part 384*a* may be the same as that of the second part 384*b*. The extension directions of the second part 384*b* and the third part 384*c* may be different from each other. The extension direction of the third part 384*c* may be different from that of the first part 384*a*. The third part 384*c* may have a constant curvature based on the Y-Z cutting surface. That is, the same curvature radius of the third part 384 may be constant in the longitudinal direction. The curvature of the second part 384*b* may be zero. When the second part 384*b* is not a straight line, the curvature of the second part 384*b* may be less than that of the third part 384. The curvature radius of the second part 384*b* may be greater than that of the third part 384.

At least a portion of the second portion 383 may be disposed at a position higher than or equal to that of the uppermost end of the ice making cell 320*a*. In this case, since the heat conduction path defined by the second portion 383 is long, the heat transfer to the ice making cell 320*a* may be reduced. A length of the second portion 383 may be greater than the radius of the ice making cell 320*a*. The second portion 383 may extend up to a point higher than the center of rotation of the shaft 440. For example, the second portion 383 may extend up to a point higher than the uppermost end of the shaft 440. The second portion 383 may include a first extension part 383*a* extending from a first point of the first portion 382 and a second extension part 383*b* extending from a second point of the first portion 382 so that transfer of the heat of the transparent ice heater 430 to the ice making cell 320*a* defined by the first tray 320 is reduced. For example, the first extension part 383*a* and the second extension part 383*b* may extend in different directions with respect to the central line C1.

Referring to FIG. 8, the first extension part 383*a* may be disposed at the left side with respect to the central line C1, and the second extension part 383*b* may be disposed at the right side with respect to the central line C1. The first extension part 383*a* and the second extension part 383*b* may have different shapes based on the central line C1. The first extension part 383*a* and the second extension part 383*b* may be provided in an asymmetrical shape with respect to the central line C1. A length (horizontal length) of the second extension part 383*b* in the Y-axis direction may be longer than the length (horizontal length) of the first extension part 383*a*. The second extension part 383*b* may be disposed closer to the shaft 440 that provides a center of rotation of the second tray assembly than the first extension part 383*a*.

In this embodiment, a length of the second extension part 383*b* in the Y-axis direction may be greater than that of the first extension part 383*a*. In this case, the heat conduction path may increase while reducing the width of the bracket 220 relative to the space in which the ice maker 200 is installed. Since the length of the second extension part 383*b* in the Y-axis direction is greater than that of the first extension part 383*a*, the second tray assembly including the second tray 380 contacting the first tray 320 may increase in radius of rotation. When the rotation radius of the second tray assembly increases centrifugal force of the second tray assembly may increase. Thus, in the ice separation process, separating force for separating the ice from the second tray assembly may increase to improve ice separation performance.

The center of curvature of at least a portion of the second extension part 383*b* may be a center of curvature of the shaft 440 which is connected to the driver 480 to rotate.

A distance between an upper portion of the first extension part 383*a* and an upper portion of the second extension part 383*b* may be greater than that between a lower portion of the first extension part 383*a* and a lower portion of the second extension part 383*b* with respect to the Y-Z cutting surface passing through the central line C1. For example, a distance between the first extension part 383*a* and the second extension part 383*b* may increase upward.

Each of the first extension part 383*a* and the second extension part 383*b* may include first to third parts 384*a*, 384*b*, and 384*c*. In another aspect, the third part 384*c* may also be described as including the first extension part 383*a* and the second extension part 383*b* extending in different directions with respect to the central line C1.

The first portion 382 may include a first region 382*d* (see region A in FIG. 8) and a second region 382*e* (a region except for the region A). The curvature of at least a portion of the first region 382*d* may be different from that of at least a portion of the second region 382*e*. The first region 382*d* may include the lowermost end of the ice making cell 320*a*. The second region 382*e* may have a diameter greater than that of the first region 382*d*. The first region 382*d* and the second region 382*e* may be divided vertically.

The transparent ice heater 430 may contact the first region 382*d*. The first region 382*d* may include a heater contact surface 382*g* contacting the transparent ice heater 430. The heater contact surface 382*g* may be, for example, a horizontal plane. The heater contact surface 382*g* may be disposed at a position higher than that of the lowermost end of the first portion 382. The second region 382*e* may include the second contact surface 382*c*. The first region 382*d* may have a shape recessed in a direction opposite to a direction in which ice is expanded in the ice making cell 320*a*.

A distance from the center of the ice making cell 320*a* to the second region 382*e* may be less than that from the center of the ice making cell 320*a* to the portion at which the shape recessed in the first region 382*d* is disposed. For example, the first region 382*d* may include a pressing part 382*f* that is pressed by the second pusher 540 during the ice separation process. When pressing force of the second pusher 540 is applied to the pressing part 382*f*, the pressing part 382*f* is deformed, and thus, ice is separated from the first portion 382. When the pressing force applied to the pressing part 382*f* is removed, the pressing part 382*f* may return to its original shape. The central line C1 may pass through the first region 382*d*. For example, the central line C1 may pass through the pressing part 382*f*. The heater contact surface 382*g* may be disposed to surround the pressing part 382*f*. The heater contact surface 382*g* may be disposed at a position higher than that of the lowermost end of the pressing part 382*f*. At least a portion of the heater contact surface 382*g* may be disposed to surround the central line C1. Accordingly, at least a portion of the transparent ice heater 430 contacting the heater contact surface 382*g* may be disposed to surround the central line C1. Therefore, the transparent ice heater 430 may be prevented from interfering with the second pusher 540 while the second pusher 540 presses the pressing part 382*f*. A distance from the center of the ice making cell 320*a* to the pressing part 382*f* may be different from that from the center of the ice making cell 320*a* to the second region 382*e*.

Figure 9:
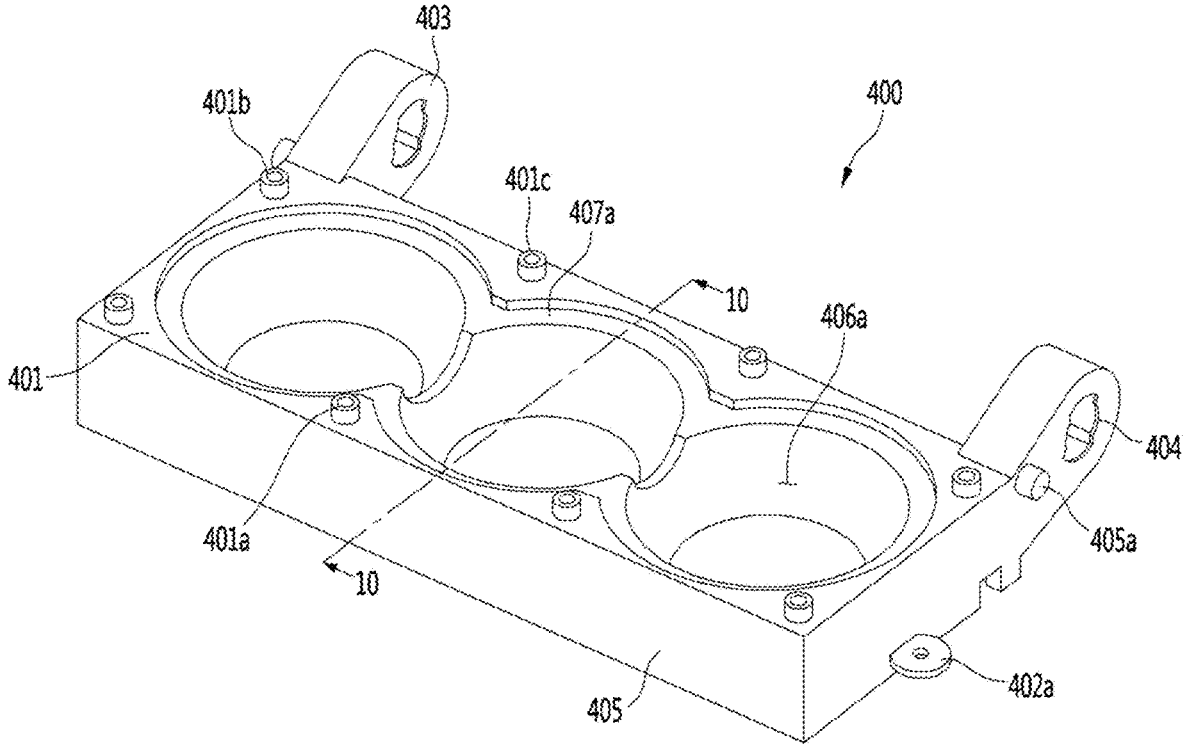
FIG. 9 is a perspective view illustrating an upper portion of a second tray supporter.
Figure 10:
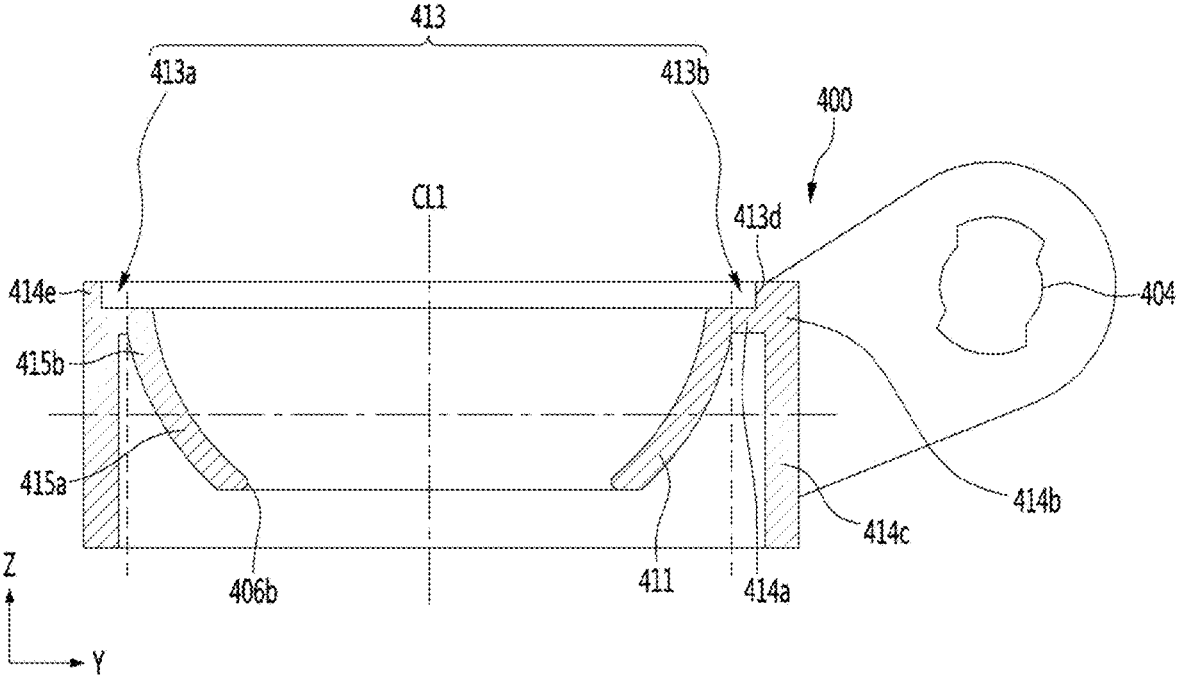
FIG. 10 is a cross-sectional view taken along line 10-10 of FIG. 9.

FIG. 9 is a perspective view illustrating an upper portion of the second tray supporter, and FIG. 10 is a cross-sectional view taken along line 10-10 of FIG. 9.

Referring to FIGS. 9 and 10, the second tray supporter 400 may include a support body 407 on which a lower portion of the second tray 380 is seated. The support body 407 may include an accommodation space 406*a* in which a portion of the second tray 380 is accommodated. The accommodation space 406*a* may be defined corresponding to the first portion 382 of the second tray 380, and a plurality of accommodation spaces 406*a* may be provided.

The support body 407 may include a lower opening 406*b* (or a through-hole) through which a portion of the second pusher 540 passes. For example, three lower openings 406*b* may be provided in the support body 407 to correspond to the three accommodation spaces 406*a*.

Also, a portion of the lower portion of the second tray 380 may be exposed by the lower opening 406*b*. At least a portion of the second tray 380 may be disposed in the lower opening 406*b*. A top surface 407*a* of the support body 407 may extend in the horizontal direction.

The second tray supporter 400 may include a top surface 407*a* of the support body 407 and a stepped lower plate 401. The lower plate 401 may be disposed at a position higher than that of the top surface 407*a* of the support body 407. The lower plate 401 may include a plurality of coupling parts 401*a*, 401*b*, and 401*c* to be coupled to the second tray cover 360. The second tray 380 may be inserted and coupled between the second tray cover 360 and the second tray supporter 400. For example, the second tray 380 may be disposed below the second tray cover 360, and the second tray 380 may be accommodated above the second tray supporter 400.

Also, the first extension wall 387*b* of the second tray 380 may be coupled to the coupling parts 361*a*, 361*b*, and 361*c* of the second tray cover 360 and the coupling parts 401*a*, 401*b*, and 401*c* of the second tray supporter 400. The second tray supporter 400 may further include a vertical extension wall 405 extending vertically downward from an edge of the lower plate 401.

One surface of the vertical extension wall 405 may be provided with a pair of extension parts 403 coupled to the shaft 440 to allow the second tray 380 to rotate. The pair of extension parts 403 may be spaced apart from each other in the X-axis direction. Also, each of the extension parts 403 may further include a through-hole 404. The shaft 440 may pass through the through-hole 404, and the extension part 281 of the first tray cover 300 may be disposed inside the pair of extension parts 403.

The second tray supporter 400 may further include a spring coupling part 402*a* to which a spring 402 is coupled. The spring coupling part 402*a* may provide a ring to be hooked with a lower end of the spring 402.

The second tray supporter 400 may further include a link connection part 405*a* to which the pusher link 500 is coupled. For example, the link connection part 405*a* may protrude from the vertical extension wall 405. Referring to FIG. 10, the second tray supporter 400 may include a first portion 411 supporting the second tray 380 defining at least a portion of the ice making cell 320*a*. In FIG. 10, the first portion 411 may be an area between two dotted lines. For example, the support body 407 may define the first portion 411. The second tray supporter 400 may further include a second portion 413 extending from a predetermined point of the first portion 411.

The second portion 413 may reduce transfer of heat, which is transfer from the transparent ice heater 430 to the second tray supporter 400, to the ice making cell 320*a* defined by the first tray 320. At least a portion of the second portion 413 may extend in a direction away from the first cell 321*a* defined by the first tray 320. In the second portion 413, the direction away from the first cell 321*a* may be a horizontal direction passing through the center of the ice making cell 320*a*. In the second portion 413, the direction away from the first cell 321*a* may be a downward direction with respect to a horizontal line passing through the center of the ice making cell 320*a*.

The second portion 413 may include a first part 414*a* extending in the horizontal direction from the predetermined point and a second part 414*b* extending in the same direction as the first part 414*a*. The second portion 413 may include a first part 414*a* extending in the horizontal direction from the predetermined point, and a third part 414*c* extending in a direction different from that of the first part 414*a*. The second portion 413 may include a first part 414*a* extending in the horizontal direction from the predetermined point, and a second part 414*b* and a third part 414*c*, which are branched from the first part 414*a*. A top surface 407*a* of the support body 407 may provide, for example, the first part 414*a*.

The first part 414*a* may further include a fourth part 414*d* extending in the vertical line direction. The lower plate 401 may provide, for example, the fourth part 414*d*. The vertical extension wall 405 may provide, for example, the third part 414*c*. A length of the third part 414*c* may be greater than that of the second part 414*b*. The second part 414*b* may extend in the same direction as the first part 414*a*. The third part 414*c* may extend in a direction different from that of the first part 414*a*.

The second portion 413 may be disposed at the same height as the lowermost end of the first cell 321*a* or extend up to a lower point. The second portion 413 may include a first extension part 413*a* and a second extension part 413*b* which are disposed opposite to each other with respect to the center line CL1 corresponding to the center line C1 of the ice making cell 320*a*.

Referring to FIG. 10, the first extension part 413*a* may be disposed at a left side with respect to the center line CL1, and the second extension part 413*b* may be disposed at a right side with respect to the center line CL1. The first extension part 413*a* and the second extension part 413*b* may have different shapes with respect to the center line CL1. The first extension part 413*a* and the second extension part 413*b* may have shapes that are asymmetrical to each other with respect to the center line CL1. A length of the second extension part 413*b* may be greater than that of the first extension part 413*a* in the horizontal direction. That is, a length of the thermal conductivity of the second extension part 413*b* is greater than that of the first extension part 413*a*. The second extension part 413*b* may be disposed closer to the shaft 440 that provides a center of rotation of the second tray assembly than the first extension part 413*a*. In this embodiment, since the length of the second extension part 413*b* in the Y-axis direction is greater than that of the first extension part 413*a*, the second tray assembly including the second tray 380 contacting the first tray 320 may increase in radius of rotation.

A center of curvature of at least a portion of the second extension part 413*a* may coincide with a center of rotation of the shaft 440 which is connected to the driver 480 to rotate. The first extension part 413*a* may include a portion 414*e* extending upwardly with respect to the horizontal line. The portion 414*e* may surround, for example, a portion of the second tray 380.

In another aspect, the second tray supporter 400 may include a first region 415*a* including the lower opening 406*b* and a second region 415*b* having a shape corresponding to the ice making cell 320*a* to support the second tray 380.

Figure 12:
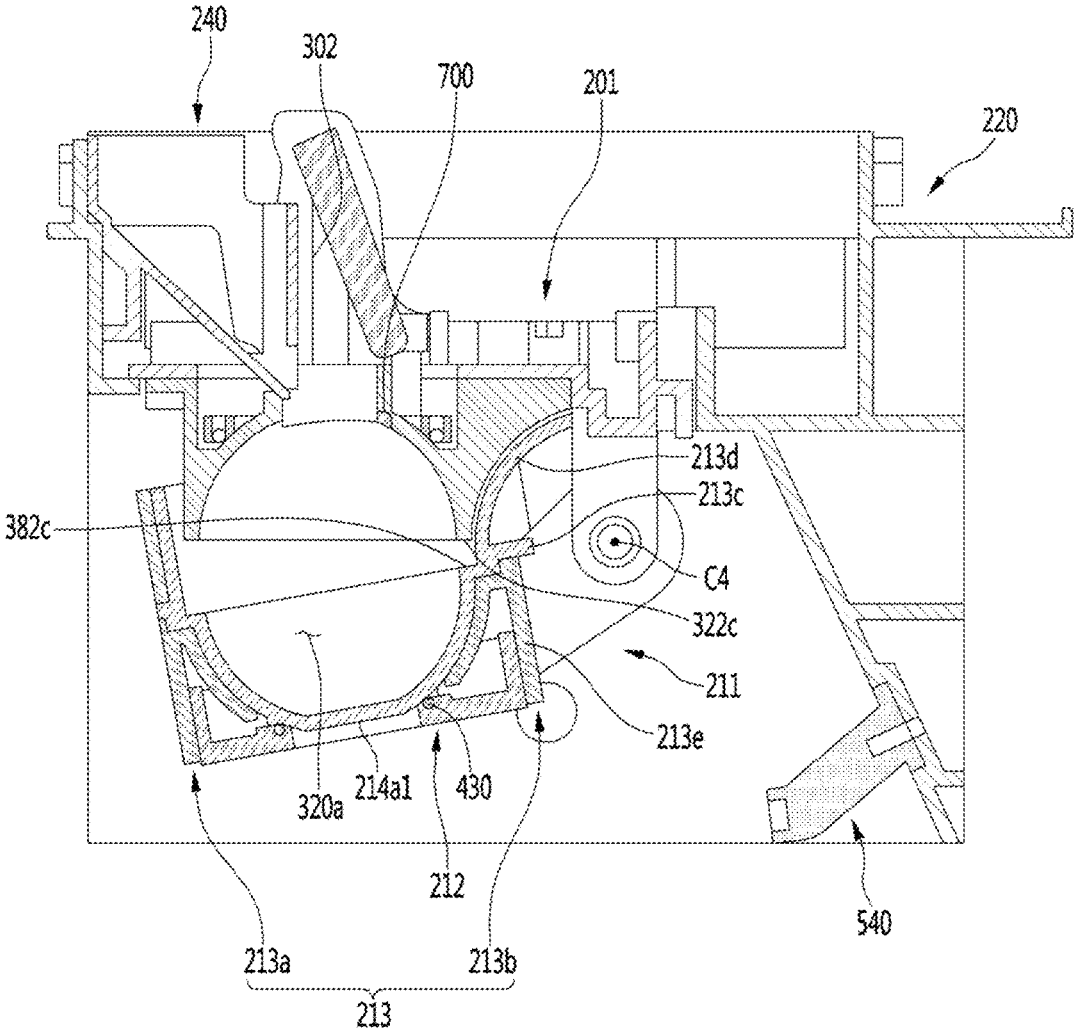
FIG. 12 is a view illustrating a state in which a second tray moves to a water supply position in FIG. 11.

For example, the first region 415*a* and the second region 415*b* may be divided vertically. In FIG. 12, for example, the first region 415*a* and the second region 415*b* are divided by a dashed-dotted line that extends in the horizontal direction. The first region 415*a* may support the second tray 380.

The controller controls the ice maker to allow the second pusher 540 to move from a first point outside the ice making cell 320*a* to a second point inside the second tray supporter 400 via the lower opening 406*b*. A deformation resistance degree of the second tray supporter 400 may be greater than that of the second tray 380. A restoration degree of the second tray supporter 400 may be less than that of the second tray 380.

In another aspect, the second tray supporter 400 includes a first region 415*a* including a lower opening 406*b* and a second region 415*b* disposed farther from the transparent ice heater 430 than the first region 415*a*.

Figure 11:
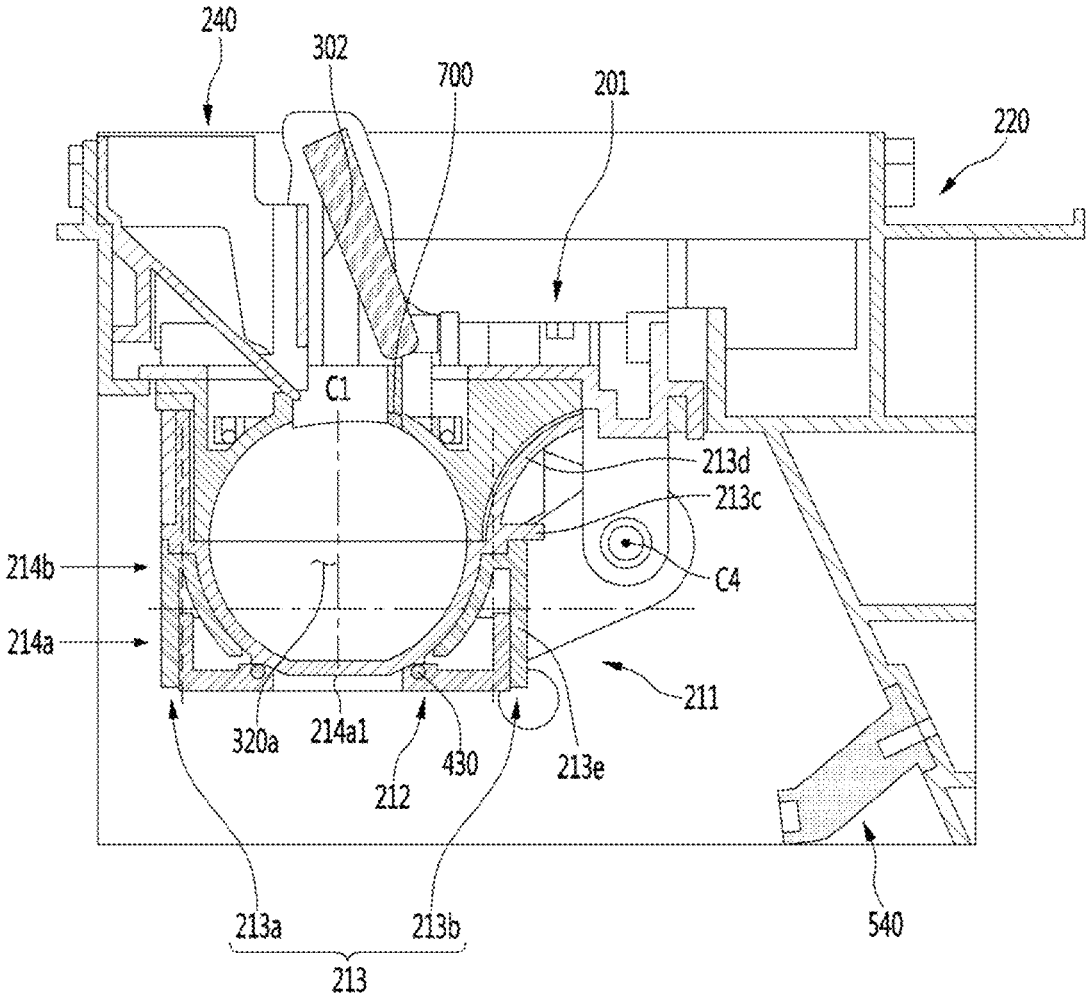
FIG. 11 is a cross-sectional view taken along line 11-11 of FIG. 2.

FIG. 11 is a cross-sectional view taken along line 11-11 of view (a) of FIG. 4, and FIG. 12 is a view illustrating a state in which the second tray moves to a water supply position in FIG. 11.

FIGS. 11 and 12, the ice maker 200 may include a first tray assembly 201 and a second tray assembly 211, which are connected to each other.

The first tray assembly 201 may include a first portion forming at least a portion of the ice making cell 320*a* and a second portion connected from the first portion to a predetermined point. The first portion of the first tray assembly 201 may include a first portion 322 of the first tray 320, and the second portion of the first tray assembly 201 may include a second portion 323 of the first tray 320. Thus, the first tray assembly 201 includes deformation resistance reinforcement parts of the first tray 320.

The first tray assembly 201 may include a first region and a second region disposed to be farther from the transparent ice heater 430 than the first region. The first region of the first tray assembly 201 may include a first region of the first tray 320, and the second region of the first tray assembly 201 may include a second region of the first tray 320.

The second tray assembly 211 may include a first portion 212 defining at least a portion of the ice making cell 320*a* and a second portion 213 extending from a predetermined point of the first portion 212. The second portion 213 may reduce transfer of heat from the transparent ice heater 430 to the ice making cell 320*a* defined by the first tray assembly 201. The first portion 212 may be an area disposed between two dotted lines in FIG. 11. The predetermined point of the first portion 212 may be an end of the first portion 212 or a point at which the first tray assembly 201 and the second tray assembly 211 meet each other.

At least a portion of the first portion 212 may extend in a direction away from the ice making cell 320*a* defined by the first tray assembly 201.

At least two portions of the second portion 213 may be branched to reduce heat transfer in the direction extending to the second portion 213. A portion of the second portion 213 may extend in the horizontal direction passing through the center of the ice making cell 320*a*. A portion of the second portion 213 may extend in an upward direction with respect to a horizontal line passing through the center of the ice making chamber 320*a*. The second portion 213 includes a first part 213*c* extending in the horizontal direction passing through the center of the ice making cell 320*a*, a second part 213*d* extending upward with respect to the horizontal line passing through the center of the ice making cell 320*a*, a third part extending downward.

The first portion 212 may have different heat transfer in a direction along the outer circumferential surface of the ice making cell 320*a* to reduce transfer of heat, which is transferred from the transparent ice heater 430 to the second tray assembly 211, to the ice making cell 320*a* defined by the first tray assembly 201.

The transparent ice heater 430 may be disposed to heat both sides with respect to the lowermost end of the first portion 212.

The first portion 212 may include a first region 214*a* and a second region 214*b*. In FIG. 11, the first region 214*a* and the second region 214*b* are divided by a dashed-dotted line that extends in the horizontal direction. The second region 214*b* may be a region defined above the first region 214*a*. The heat transfer rate of the second region 214*b* may be greater than that of the first region 214*a*. The first region 214*a* may include a portion at which the transparent ice heater 430 is disposed. That is, the first region 214*a* may include the transparent ice heater 430. The lowermost end 214*a*1 of the ice making cell 320*a* in the first region 214*a* may have a heat transfer rate less than that of the other portion of the first region 214*a*.

A distance from the center of the ice making cell 320*a* to the outer circumferential surface is greater in the second region 214*b* than in the first region 214*a*. The second region 214*b* may include a portion in which the first tray assembly 201 and the second tray assembly 211 contact each other. The first region 214*a* may provide a portion of the ice making cell 320*a*. The second region 214*b* may provide the other portion of the ice making cell 320*a*. The second region 214*b* may be disposed farther from the transparent ice heater 430 than the first region 214*a*.

A portion of the first region 214*a* may have the heat transfer degree less than that of the other part of the first region 214*a* to reduce transfer of heat, which is transferred from the transparent ice heater 430 to the first region 214*a*, to the ice making cell 320*a* defined by the second region 214*b*. To make ice in the direction from the ice making cell 320*a* defined by the first region 214*a* to the ice making cell 320*a* defined by the second region 214*b*, a portion of the first region 214*a* may have a deformation resistance degree less than that of the other portion of the first region 214*a* and a restoration degree greater than that of the other portion of the first region 214*a*.

A portion of the first region 214*a* may be thinner than the other portion of the first region 214*a* in the thickness direction from the center of the ice making cell 320*a* to the outer circumferential surface direction of the ice making cell 320*a*.

For example, the first region 214*a* may include a second tray case surrounding at least a portion of the second tray 380 and at least a portion of the second tray 380. For example, the first region 214*a* may include the pressing part 382*f* of the second tray 380.

The rotation center C4 of the shaft 440 may be disposed closer to the second pusher 540 than to the ice making cell 320*a*.

The second portion 213 may include a first extension part 213*a* and a second extension part 213*b*, which are disposed at sides opposite to each other with respect to the central line C1. The first extension part 213*a* may be disposed at a left side of the center line C1 in FIG. 11, and the second extension part 213*b* may be disposed at a right side of the center line C1. The water supply part 240 may be disposed close to the first extension part 213*a*. The first tray assembly 301 may include a pair of guide slots 302, and the water supply part 240 may be disposed in a region between the pair of guide slots 302. The ice maker 200 according to this embodiment may be designed so that a position of the second tray 380 is different from the water supply position and the ice making position. In FIG. 12, as an example, a water supply position of the second tray 380 is illustrated. For example, in the water supply position as illustrated in FIG. 12, at least a portion of a first contact surface 322*c* of the first tray 320 and a second contact surface 382*c* of the second tray 380 may be spaced apart from each other. In FIG. 12, for example, a shape in which the entire first contact surface 322*c* is spaced apart from the entire second contact surface 382*c*. Thus, at the water supply position, the first contact surface 322*c* may be inclined at a predetermined angle with respect to the second contact surface 382*c*.

Although not limited thereto, at the water supply position, the first contact surface 322*c* may be substantially maintained horizontally, and the second contact surface 382*c* may be disposed to be inclined with respect to the first contact surface 322*c* under the first tray 320.

At the ice making position (see FIG. 11), the second contact surface 382*c* may be in contact with at least a portion of the first contact surface 322*c*. The angle defined by the second contact surface 382*c* of the second tray 380 and the first contact surface 322*c* of the first tray 320 at the ice making position is less than that defined by the second contact surface of the second tray 380 and the first contact surface 322*c* of the first tray 320 at the water supply position. At the ice making position, the entire first contact surface 322*c* may be in contact with the second contact surface 382*c*. At the ice making position, the second contact surface 382*c* and the first contact surface 322*c* may be disposed to be substantially horizontal. In this embodiment, the water supply position of the second tray 380 and the ice making position are different from each other. This is done for uniformly distributing the water to the plurality of ice making cells 320*a* without providing a water passage for the first tray 320 and/or the second tray 380 when the ice maker 200 includes the plurality of ice making cells 320*a*.

If the ice maker 200 includes the plurality of ice making cells 320*a*, when the water passage is provided in the first tray 320 and/or the second tray 380, the water supplied into the ice maker 200 may be distributed to the plurality of ice making cells 320*a* along the water passage.

However, when the water is distributed to the plurality of ice making cells 320*a*, the water also exists in the water passage, and when ice is made in this state, the ice made in the ice making cells 320*a* may be connected by the ice made in the water passage portion.

In this case, there is a possibility that the ice sticks to each other even after the completion of the ice, and even if the ice is separated from each other, some of the plurality of ice includes ice made in a portion of the water passage. Thus, the ice may have a shape different from that of the ice making cell.

However, like this embodiment, when the second tray 380 is spaced apart from the first tray 320 at the water supply position, water dropping to the second tray 380 may be uniformly distributed to the plurality of second cells 381*a* the second tray 380.

The water supply part 240 may supply water to one opening of the plurality of openings 324. In this case, the water supplied through the one opening 324 falls to the second tray 380 after passing through the first tray 320. In the water supply process, water may fall into any one second cell 381*a* of the plurality of second cells 381*a* of the second tray 380. The water supplied to any one second cell 381*a* may overflow from any one second cell 381*a*.

In this embodiment, since the second contact surface 382*c* of the second tray 380 is spaced apart from the first contact surface 322*c* of the first tray 320, the water overflowed from any one second cells 381*a* may move to the other adjacent second cell 381*a* along the second contact surface 382*c* of the second tray 380. Therefore, the plurality of second cells 381*a* the second tray 380 may be filled with water.

Also, in the state in which water supply is completed, a portion of the water supplied may be filled in the second cell 381*a*, and the other portion of the water supplied may be filled in the space between the first tray 320 and the second tray 380.

When the second tray 380 move from the water supply position to the ice making position, the water in the space between the first tray 320 and the second tray 380 may be uniformly distributed to the plurality of first cells 321*a*.

When water passages are provided in the first tray 320 and/or the second tray 380, ice made in the ice making cell 320*a* may also be made in a portion of the water passage.

In this case, when the controller of the refrigerator controls one or more of the cooling power of the cold air supply part 900 and the heating amount of the transparent ice heater to vary according to the mass per unit height of the water in the ice making cell 320*a*, one or more of the cooling power of the cold air supply part 900 and the heating amount of the transparent ice heater may be abruptly changed several times or more in the portion at which the water passage is provided.

This is because the mass per unit height of the water increases more than several times in the portion at which the water passage is provided. In this case, reliability problems of components may occur, and expensive components having large maximum output and minimum output ranges may be used, which may be disadvantageous in terms of power consumption and component costs. As a result, the present invention may require the technique related to the aforementioned ice making position to make the transparent ice.

The refrigerator may further include a second temperature sensor 700 (or ice making cell temperature sensor).

The second temperature sensor 700 may be disposed adjacent to the first tray 320 to sense the temperature of the first tray 320, thereby indirectly determining the water temperature or the ice temperature of the ice making cell 320*a*. Alternatively, the second temperature sensor 700 may be exposed from the second tray 320 to the ice making cell 320*a* to directly detect a temperature of the ice making cell 320*a*. In this embodiment, the temperature of the ice making cell 320*a* may be a temperature of water, ice, or cold air.

In this embodiment, the second temperature sensor 700 may be used to determine whether an amount of water supplied to the ice making cell 320*a* reaches a target water supply amount.

The second temperature sensor 700 may be disposed adjacent to an upper end of the ice making cell 320*a*. The upper end of the ice making cell 320*a* may be a portion in which the opening 324 of the first tray 320 is formed.

The lowermost end of the second temperature sensor 700 may be disposed lower than the upper end of the ice making cell 320*a*. When the lowermost end of the second temperature sensor 700 is disposed lower than the upper end of the ice-making cell 320*a*, in a state in which water is supplied to the ice making cell 320*a* as much as the target water supply amount, the uppermost end of the supplied water may be lower than the upper end of the ice making cell 320*a*.

Since water expands in the process of being phase-changed into ice, if the uppermost end of the supplied water is equal to or higher than the upper end of the ice making cell 320*a*, a portion of the expanded ice is disposed in the auxiliary storage chamber 325. As a result, there are problems that the ice is not easily separated from the first tray 320, and also, the shape of the ice is not the same as the shape of the ice making cell 320*a*. However, according to the present invention, the problems may be prevented in advance.

Figure 13:
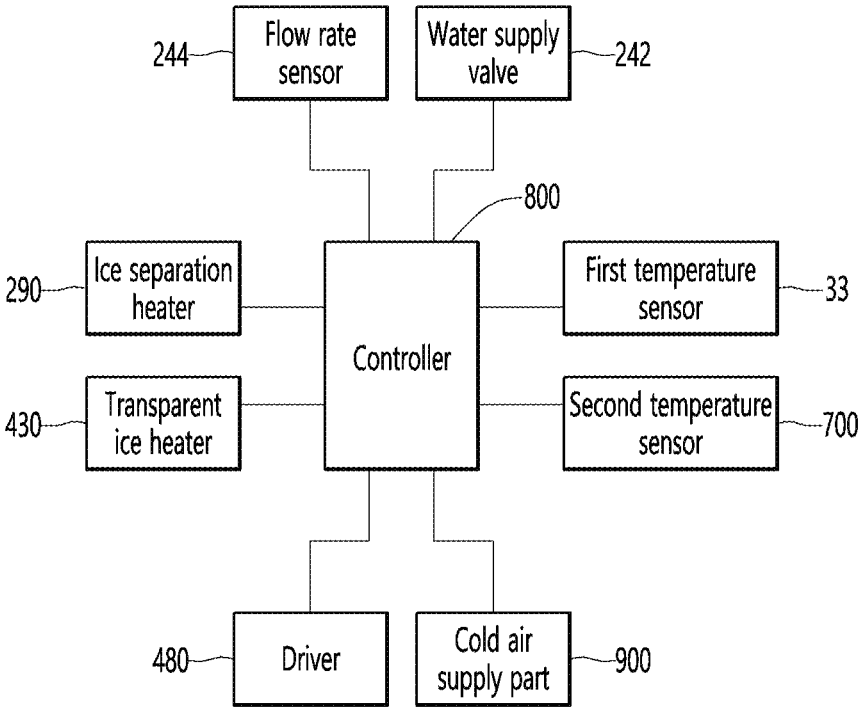
FIG. 13 is a control block diagram of a refrigerator according to an embodiment of the present invention.

FIG. 13 is a control block diagram of the refrigerator according to an embodiment.

Referring to FIG. 13, the refrigerator according to this embodiment may include a cooler supplying a cold air to the freezing compartment 32 (or the ice making cell). In this embodiment, the cooler may include at least one of a cold air supply part including at least evaporator or a thermoelectric element so as to be defined as a unit for cooling the storage chamber. In FIG. 13, for example, the cooler includes a cold air supply part 900.

The cold air supply part 900 may supply cold air, which is an example of the cold, to the freezing compartment 32 using a refrigerant cycle.

For example, the cold air supply part 900 may include a compressor compressing the refrigerant. A temperature of the cold air supplied to the freezing compartment 32 may vary according to the output (or frequency) of the compressor. Alternatively, the cold air supply part 900 may include a fan blowing air to the evaporator. An amount of cold air supplied to the freezing compartment 32 may vary according to the output (or rotation rate) of the fan. Alternatively, the cold air supply part 900 may include a refrigerant valve (expansion valve) controlling an amount of refrigerant flowing through the refrigerant cycle. An amount of refrigerant flowing through the refrigerant cycle may vary by adjusting an opening degree by the refrigerant valve, and thus, the temperature of the cold air supplied to the freezing compartment 32 may vary.

Therefore, in this embodiment, the cold air supply part 900 may include one or more of the compressor, the fan, and the refrigerant valve.

The cold air supply part 900 may further include the evaporator exchanging heat between the refrigerant and the air. The cold air heat-exchanged with the evaporator may be supplied to the ice maker 200.

The refrigerator according to this embodiment may further include a controller 800 that controls the cold air supply part 900. Also, the refrigerator may further include a flow sensor 244 for detecting an amount of water supplied through the water supply part 240 and a water supply valve 242 controlling an amount of water.

The flow sensor 244 may include an impeller equipped with a magnet, a hall sensor detecting magnetism during rotation of the impeller, and a housing in which the impeller is accommodated. When the hall sensor detects the magnetism of the magnet while the impeller rotates, or when the hall sensor and the magnet are aligned, a first signal may be output from the hall sensor. When the hall sensor does not detect the magnetism of the magnet, or the magnet is spaced a predetermined distance from the hall sensor, a second signal is output from the hall sensor.

Since the first signal (pulse) is repetitively output, it is possible to confirm the water supply amount by counting the number of first signals. Hereinafter, a comparison of the number of pulses of the first signal to the reference number will be described.

The controller 800 may control the water supply valve 242 using the counted number of first signals.

The controller 800 may control a portion or all of the ice separation heater 290, the transparent ice heater 430, the driver 480, the cold air supply part 900, and the water supply valve 242.

In this embodiment, when the ice maker 200 includes both the ice separation heater 290 and the transparent ice heater 430, an output of the ice separation heater 290 and an output of the transparent ice heater 430 may be different from each other.

When the outputs of the ice separation heater 290 and the transparent ice heater 430 are different from each other, an output terminal of the ice separation heater 290 and an output terminal of the transparent ice heater 430 may be provided in different shapes, incorrect connection of the two output terminals may be prevented. Although not limited, the output of the ice separation heater 290 may be set larger than that of the transparent ice heater 430. Accordingly, ice may be quickly separated from the first tray 320 by the ice separation heater 290.

In this embodiment, when the ice separation heater 290 is not provided, the transparent ice heater 430 may be disposed at a position adjacent to the second tray 380 described above or be disposed at a position adjacent to the first tray 320.

The refrigerator may further include a first temperature sensor 33 that detects a temperature of the freezing compartment 32. The controller 800 may control the cold air supply part 900 based on the temperature sensed by the first temperature sensor 33.

The controller 800 may determine whether ice making is completed based on the temperature sensed by the second temperature sensor 700.

Also, the controller 800 may determine whether the water supply amount reaches the target water supply amount based on the temperature detected by the second temperature sensor 700.

When an amount of water as much as the target water supply amount is supplied to the ice making cell 320*a*, the second temperature sensor 700 may be in contact with water. The temperature of the water supplied to the ice making cell 320*a* is a temperature that is above zero and may be room temperature or slightly lower than room temperature. Thus, the temperature detected by the second temperature sensor 700 may be higher than the reference temperature, which is the temperature that is above zero.

On the other hand, when an amount of water, which is less than the target water supply amount, is supplied to the ice making cell 320*a*, the cold air is disposed in a region corresponding to an insufficient water supply amount in the ice making cell 320*a*. Since the temperature of the cold air is sub-zero, the temperature detected by the second temperature sensor 700 in contact with the cold air will be lower than the reference temperature.

Thus, when the temperature detected by the second temperature sensor 700 is equal to or higher than the reference temperature, the controller 800 determines that the water supply amount of the ice making cell 320*a* reaches the target water supply amount. On the other hand, if the temperature detected by the second temperature sensor 700 is less than the reference temperature, it is determined that the water supply amount of the ice making cell 320*a* does not reach the target water supply amount.

In this embodiment, the second temperature sensor 700 may be referred to as a water supply amount detection part or sensor for detecting the water supply amount.

As another example, it is possible to include a water supply amount detection part that is provided separately from the second temperature sensor. For example, the water supply amount detection part may be, for example, a capacitive sensor.

A signal (first signal) output from the water supply amount detection part when the water supply amount detection part is in contact with water, and a signal (second signal) output from the water supply amount detection part when the water supply amount detection part is not in contact with water are different from each other. Thus, when the first signal is output from the water supply amount detection part, the controller may determine that the water supply amount of the ice making cell reaches the target water supply amount.

In order that the water supply amount detection part is in contact with water, the water supply amount detection part may be exposed to the ice making cell. An end of the water supply amount detection part, which is in contact with water, may be disposed lower than the upper end of the ice making cell.

Figure 14:
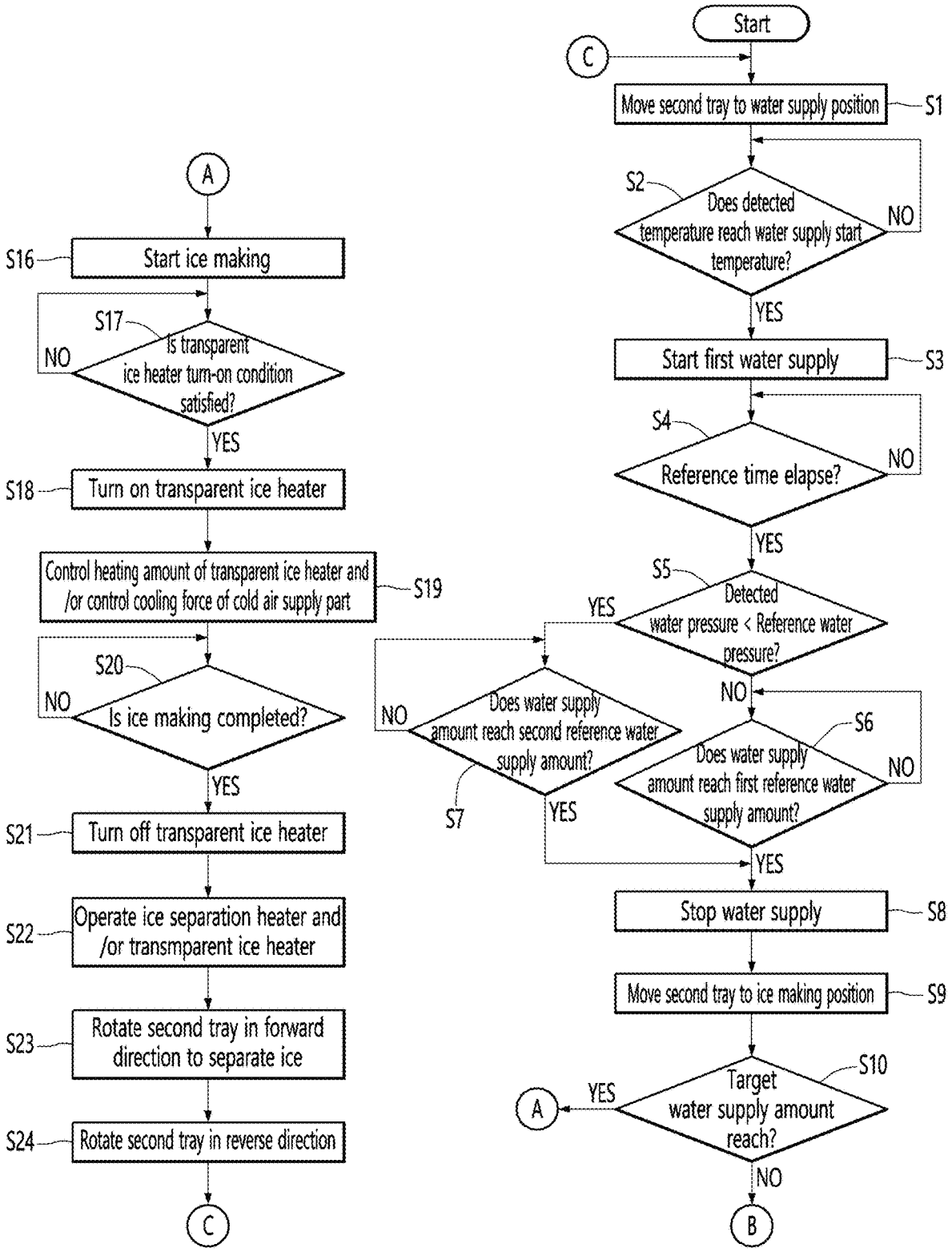
FIGS. 14 and 15 are flowcharts for explaining a process of making ice in the ice maker according to an embodiment of the present invention.
Figure 15:
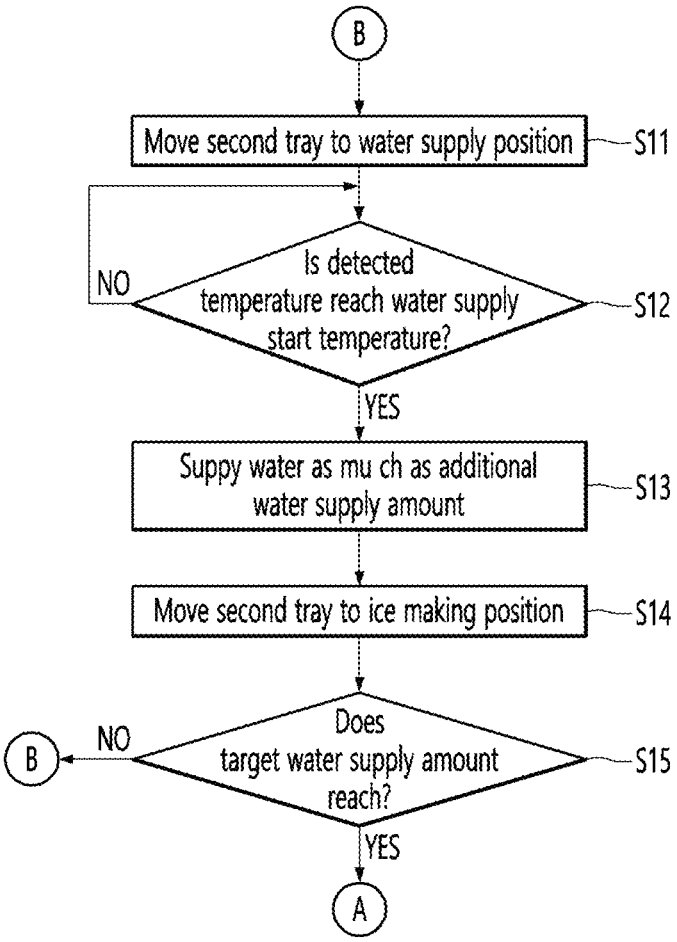

FIGS. 14 and 15 are flowcharts for explaining a process of making ice in the ice maker according to an embodiment of the present invention.

Figure 16:
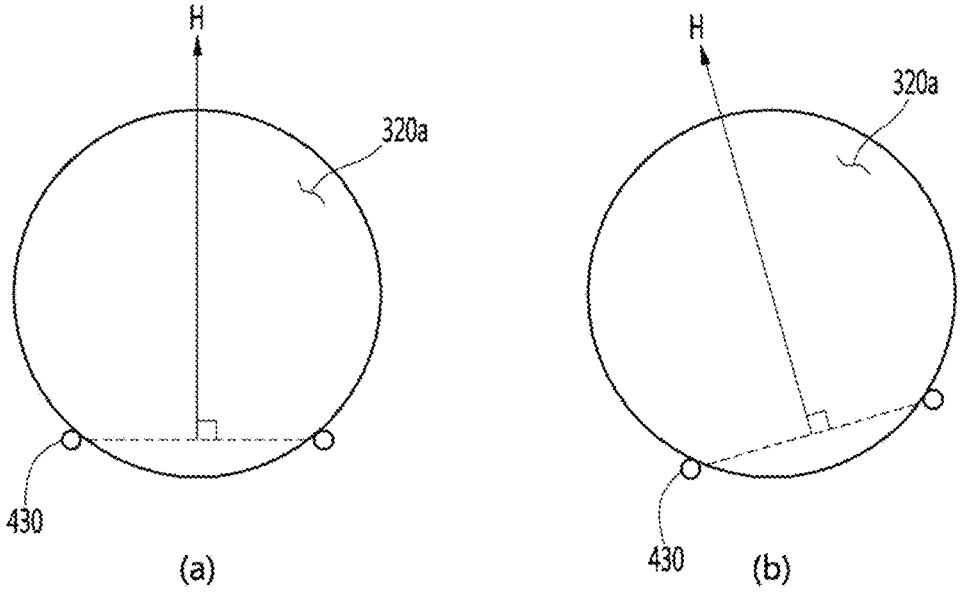
FIG. 16 is a view for explaining a height reference depending on a relative position of the transparent heater with respect to the ice making cell.
Figure 17:
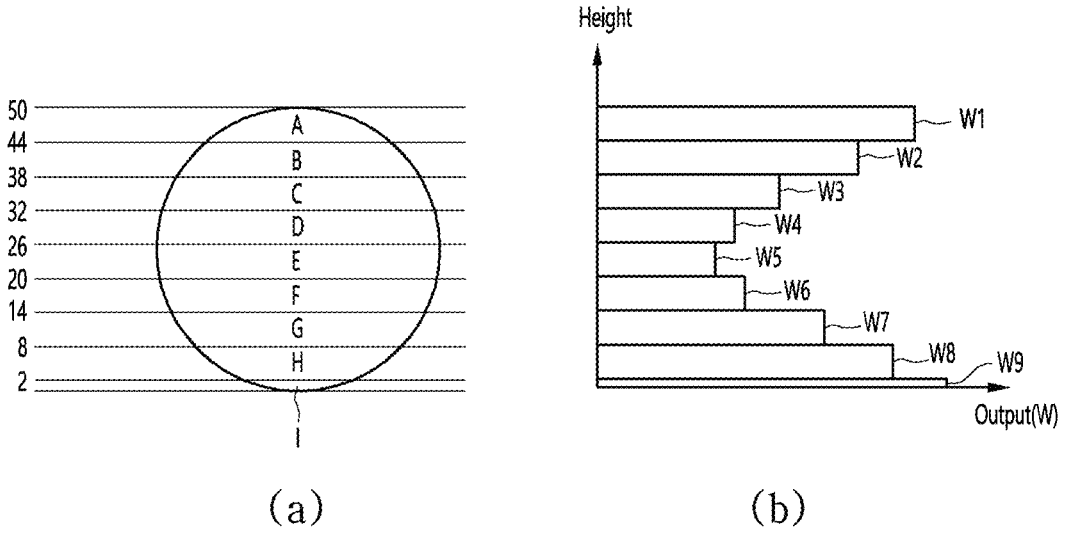
FIG. 17 is a view for explaining an output of the transparent heater per unit height of water within the ice making cell.

FIG. 16 is a view for explaining a height reference depending on a relative position of the transparent heater with respect to the ice making cell, and FIG. 17 is a view for explaining an output of the transparent heater per unit height of water within the ice making cell.

Figure 18:
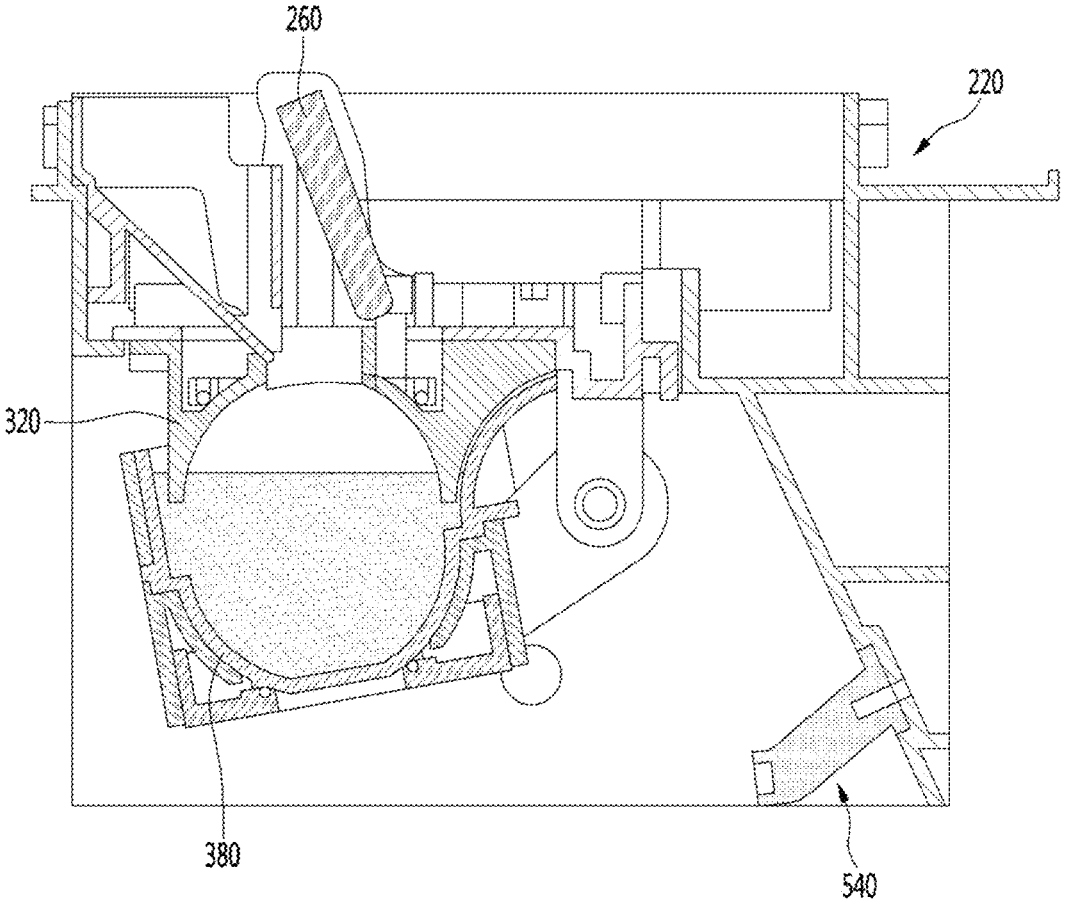
FIG. 18 is a view illustrating a state in which water supply is complete.
Figure 19:
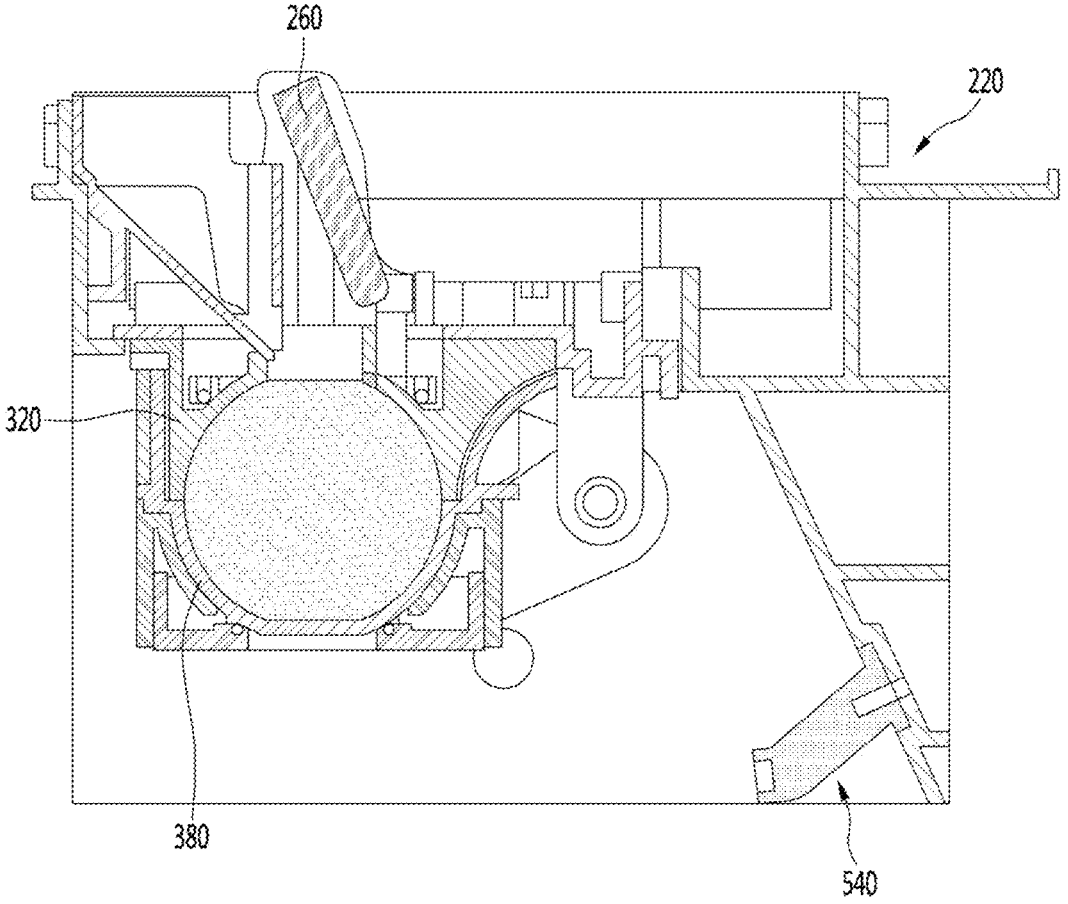
FIG. 19 is a view illustrating a state in which ice is made at an ice making position.
Figure 20:
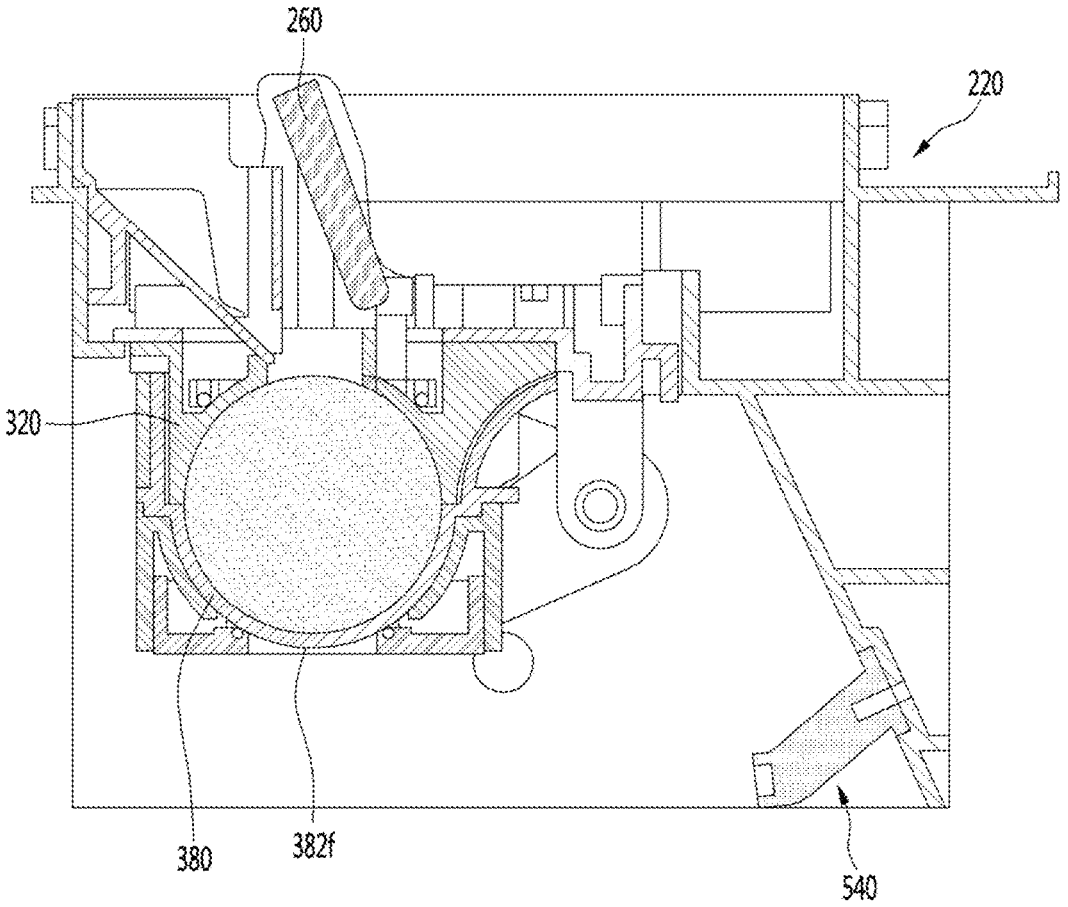
FIG. 20 is a view illustrating a state in which a pressing part of the second tray is deformed in a state in which ice making is complete.
Figure 21:
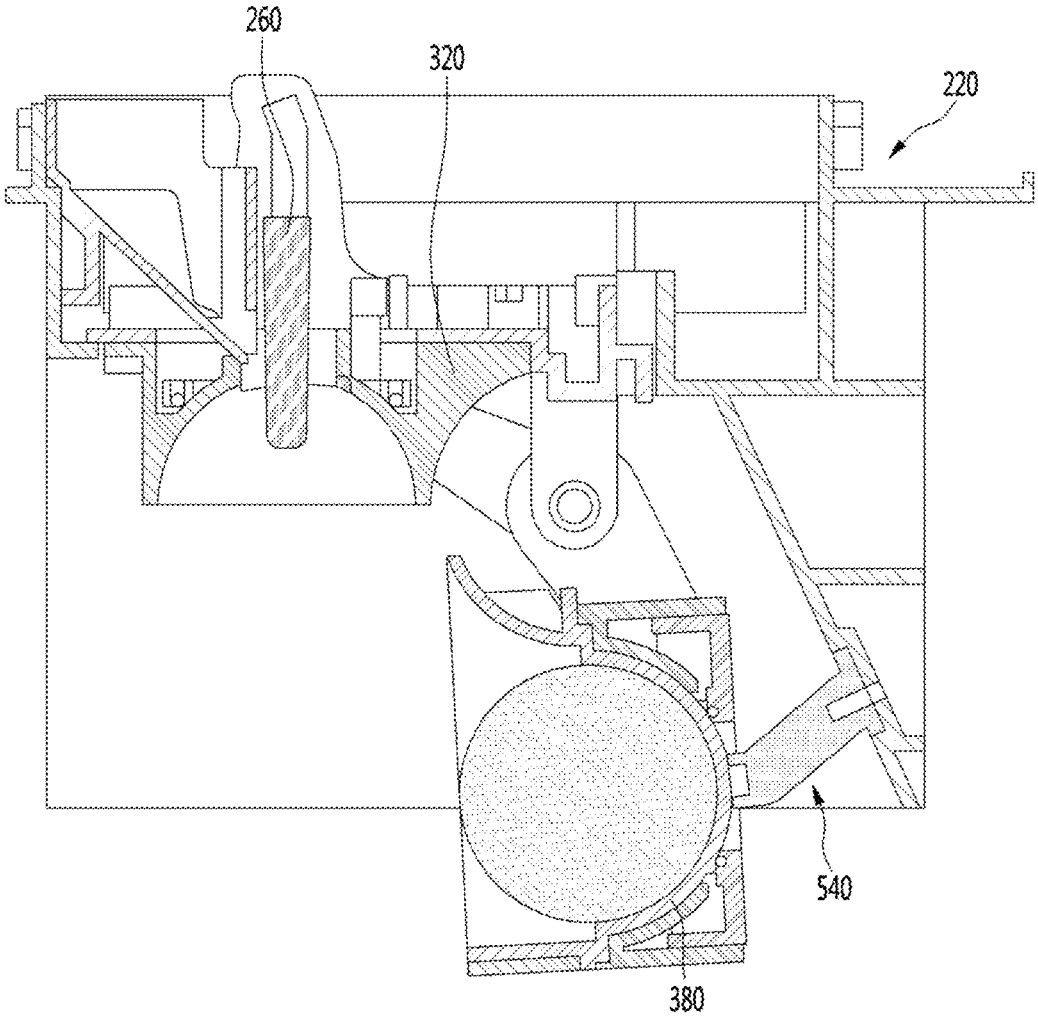
FIG. 21 is a view illustrating a state in which a second pusher is in contact with the second tray in an ice separation process.
Figure 22:
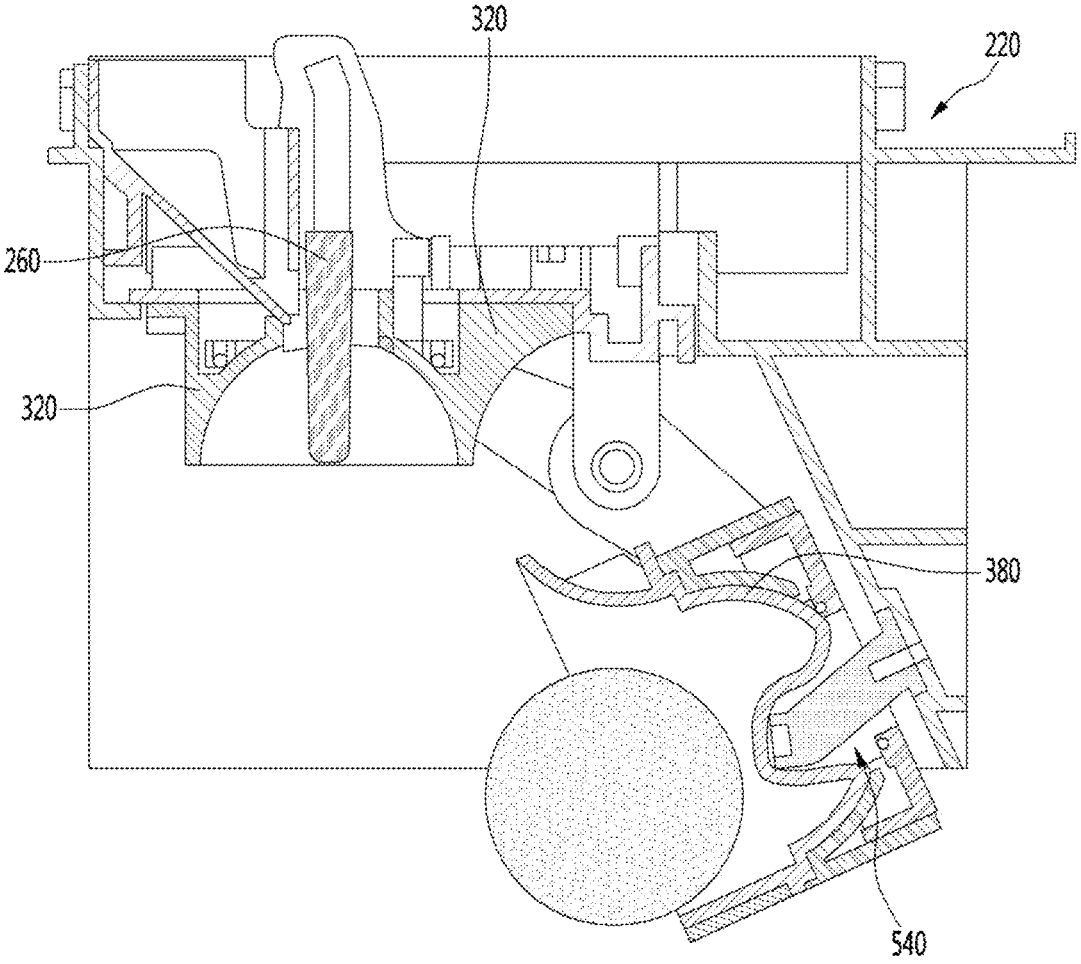
FIG. 22 is a view illustrating a state in which the second tray moves to an ice separation position in the ice separation process.

FIG. 18 is a view illustrating a state in which water supply is complete, FIG. 19 is a view illustrating a state in which ice is made at an ice making position, FIG. 20 is a view illustrating a state in which a pressing part of the second tray is deformed in a state in which ice making is complete, FIG. 21 is a view illustrating a state in which a second pusher is in contact with the second tray in an ice separation process, and FIG. 22 is a view illustrating a state in which the second tray moves to an ice separation position in the ice separation process.

Referring to FIGS. 14 to 22, to make ice in the ice maker 200, the controller 800 moves the second tray 380 to a water supply position (51).

In this specification, a direction in which the second tray 380 moves from the ice making position of FIG. 19 to the ice separation position of FIG. 22 may be referred to as forward movement (or forward rotation). On the other hand, the direction from the ice separation position of FIG. 22 to the water supply position of FIG. 18 may be referred to as reverse movement (or reverse rotation).

The movement to the water supply position of the second tray 380 is detected by a sensor (not shown), and when it is detected that the second tray 380 moves to the water supply position, the controller 800 stops the driver 480.

In a state in which the second tray 380 moves to the water supply position, the controller 800 may determine whether the temperature detected by the second temperature sensor 700 reaches a temperature below the water supply start temperature (S2).

As described later, after the ice making is completed, the ice separation heater 290 and/or the ice making heater 430 operate to separate ice. Heat from the ice separation heater 290 and/or the ice making heater 430 is provided to the ice making cell 320*a*. The temperature detected by the second temperature sensor 700 may increase to a temperature higher than a temperature that is above zero due to the heat provided to the ice making cell 320*a*.

If the water supply starts immediately after the ice separation is completed, it is determined that the temperature detected by the second temperature sensor 700 reaches a water supply start temperature by an effect of heat of the heater even though water as much as the target water supply amount has not been supplied to the ice making cell 320*a*.

As described above, when ice making starts in a state in which water less than the target water supply amount is supplied, the completion of the ice making may be determined in a state in which the ice is not completely frozen, and the ice does not become transparent.

Accordingly, in this embodiment, the water supply does not start immediately after the ice separation is completed, but stands by so that the temperature detected by the second temperature sensor 700 decreases due to the cold air. When the temperature detected by the second temperature sensor 700 decreases to a temperature that is equal to or lower than the water supply start temperature, the water supply may start. As another example, the water supply may start when a set standby time elapses after the ice separation is completed. The set standby time may be set to a time so that the temperature detected by the second temperature sensor 700 is sufficiently lowered by the cold air. The water supply start temperature may be a temperature lower than the reference temperature. The water supply start temperature may be a sub-zero temperature.

As a result of the determination in operation S2, when it is determined that the temperature detected by the second temperature sensor 700 reaches a temperature equal to or less than the water supply start temperature, the controller 800 starts the first water supply (S3). That is, the controller 800 turns on the water supply valve 242 to supply water to the ice making cell 320*a*.

In order to allow the impeller to rotate within the housing of the flow sensor 244, a gap exists between the impeller and an inner circumferential surface of the housing. When the impeller rotates, a portion of water flows by the impeller, and the other portion is bypassed to flow through the gap between the impeller and the inner circumferential surface of the housing.

When the water supply water pressure is within a normal water pressure range, if the water pressure is relatively high, an amount of water flowing through the gap between the impeller and the inner circumferential surface of the housing is small. Thus, even if the number of pulses output in the rotation process of the impeller reaches the reference number corresponding to the target water supply amount, and the water supply valve is turned off, an actual water supply amount is the same as or almost similar to the target water supply amount.

When the water supply water pressure is within a normal water pressure range, if the water pressure is relatively low, an amount of water flowing through the gap between the impeller and the inner circumferential surface of the housing increases.

In this case, when the number of pulses output in the rotation process of the impeller reaches the reference number corresponding to the target water supply amount, and the water supply valve 242 is turned off, the actual water supply amount is greater than the target water supply amount.

If the actual water supply amount is greater than the target water supply amount, since water is filled up to a position higher than the opening 324 of the ice making cell 320*a*, ice is generated up to the auxiliary storage chamber 325 or protrudes outside the auxiliary storage chamber 325 during the ice making process.

On the other hand, if the water pressure is lower than the reference water pressure, which is the lower limit of the normal water pressure range, the number of pulses output in the rotation process of the impeller reaches the reference number corresponding to the target water supply amount because a flow rate itself is small in the passage through which water flows. Even when the valve 242 is turned off, the actual water supply amount is significantly smaller than the target water supply amount.

Also, when a filter provided on a passage through which water flows is replaced, or at an initial stage of operation after purchasing the refrigerator, the passage may not be completely filled with water, and air may be contained.

When water and air are contained in the passage, even if the water supply is performed as much as the target water supply amount, the actual water supply amount may be smaller than the target water supply amount. If the ice making starts immediately in this state, it may be determined that the ice making is completed in a state in which ice is not completely frozen, and the ice may not become transparent.

Therefore, in this embodiment, the water pressure is different for each area on which the refrigerator is installed, and in consideration of the structural characteristics of the flow sensor, the water supply is performed at least twice or more so that the water supply amount is the same as or almost similar to the target water supply amount. Here, when the first water supply is performed, it is possible to control the water supply as much as the standard water supply amount less than the target water supply amount.

The water supply starts, and the controller 800 determines whether a reference time elapses (S4), and when the reference time elapses, the water supply pressure may be determined (or detected). The controller 800 may determine whether the detected water pressure is less than the reference water pressure (S5).

For example, depending on a hydraulic pressure, the number of pulses output during the rotation of the impeller after the reference time elapses may vary. The number of pulses when the water pressure is low is smaller than the number of pulses when the water pressure is high.

Thus, the controller 800 may determine whether the detected water pressure is less than the reference water pressure based on the number of pulses.

Depending on the detected water pressure, the water supply amount (reference water supply amount or a predetermined amount of liquid supplied) after the completion of the first water supply may be set differently. When the water pressure is low, the water supply amount after the completion of the first water supply is less than the water supply amount when the water pressure is high.

Thus, when the water pressure is low, the number of additional water supply increases until the water supply amount reaches the target water supply amount, and thus, there is a disadvantage that the water supply time increases. In addition, when the water supply time increases, the water in the ice making cell is changed into ice during the water supply process, thereby reducing transparency.

Thus, in this embodiment, in order to minimize an increase in water supply time, the reference water supply amount when the water supply water pressure is low may be set to be larger than the reference water supply amount when the water supply water pressure is high.

For example, as a result of the determination in operation S5, if it is determined that the detected water pressure is equal to or greater than the reference water pressure, the controller 800 sets the reference water supply amount as the first reference water supply amount. On the other hand, when the detected water pressure is less than the reference water pressure, the controller 800 sets the reference water supply amount as the second reference water supply amount. The second reference water supply amount is greater than the first reference water supply amount.

Thus, if it is determined that the detected water pressure is greater than or equal to the reference water pressure, when the number of pulses output from the flow sensor 244 reaches the first reference number corresponding to the first reference water supply amount (S6), the controller 800 turns off the water supply valve 242 to stop the water supply (S8). On the other hand, if it is determined that the detected water pressure is less than or equal to the reference water pressure, when the number of pulses output from the flow sensor 244 reaches the second reference number corresponding to the second reference water supply amount (S7), the controller 800 turns off the water supply valve 242 to stop the water supply (S8).

After the water supply is stopped, the controller 800 controls the driver 480 to allow the second tray 380 to move to the ice making position (S9).

At this time, after the first water supply is completed, the driver 480 may be controlled so that the second tray 380 moves to the ice making position after standing by for a standby time until water is distributed to the plurality of ice making cells 320*a*.

For example, the controller 800 may control the driver 480 to allow the second tray 380 to move from the water supply position in the reverse direction. When the second tray 380 move in the reverse direction, the second contact surface 382*c* of the second tray 380 comes close to the first contact surface 322*c* of the first tray 320. Then, water between the second contact surface 382*c* of the second tray 380 and the first contact surface 322*c* of the first tray 320 is divided into each of the plurality of second cells 381*a* and then is distributed. When the second contact surface 382*c* of the second tray 380 and the first contact surface 322*c* of the first tray 320 contact each other, water is filled in the first cell 321*a*.

The movement to the ice making position of the second tray 380 is detected by a sensor, and when it is detected that the second tray 380 moves to the ice making position, the controller 800 stops the driver 480.

After the second tray 380 moves to the ice making position, the controller 800 may determine whether the actual water supply amount of the ice making cell 320*a* reaches a target water supply amount (S10). For example, after moving to the ice making position, it may be determined whether the temperature detected by the second temperature sensor 700 reaches a reference temperature within a set time.

As a result of determination in operation S10, if the temperature detected by the second temperature sensor 700 reaches the reference temperature, it is determined that the water supply amount reaches the target water supply amount, and the ice making may start (S16).

On the other hand, as a result of determination in operation S10, if the temperature detected by the second temperature sensor 700 does not reach the reference temperature, the controller 800 may perform additional water supply.

For example, the controller 800 may control the driver 480 so that the second tray 380 moves again to the water supply position (S11).

After the second tray 380 moves to the water supply position, the controller 800 may determine whether the temperature detected by the second temperature sensor 700 reaches a water supply start temperature (S12).

In a state in which the second tray 380 moves to the water supply position for the additional water supply, a case in which the door is opened to increase in temperature of the freezing compartment 32 or a case in which defrosting is performed to increase in temperature of the freezing compartment 32 may occur.

In this state, when the additional water supply is performed, and it is determined whether the water supply amount reaches the target water supply amount after the second tray 380 moves to the ice making position, a determination error occurs. That is, there is a concern that the ice making may start in a state in which the water supply amount does not reach the target water supply amount.

For example, although the water supply amount does not reach the target water supply amount, it is determined that the temperature detected by the second temperature sensor 700 reaches the reference temperature due to the increase in temperature of the freezing compartment 32, so that it is erroneously determined that the water supply amount reaches the target water supply amount.

In this embodiment, in order to prevent the occurrence of the determination error in the process of determining whether the water supply amount reaches the target water supply amount after the additional water supply, it is determined whether the temperature detected by the second temperature sensor 700 reaches the water supply start temperature before the additional water supply.

As a result of determination in operation S12, when the temperature detected by the second temperature sensor 700 reaches the water supply start temperature, the water supply valve 242 may be controlled so that the water supply is performed by the additional water supply amount (S13).

In this embodiment, the additional water supply amount is less than the reference water supply amount.

The controller 800 turns on the water supply valve 242 for water supply, and when the number of pulses output from the flow sensor 244 reaches an additional water supply reference number corresponding to the additional water supply amount, the water supply valve 242 is turned off.

In this case, the additional water supply amount may be set differently according to the detected water pressure determined in operation S5.

For example, when the detected water pressure is less than the reference water pressure, the additional water supply amount may be set to be larger than the additional water supply amount when the detected water pressure is higher than the reference water pressure.

As described above, when the additional water supply amount when the detected water pressure is less than the reference water pressure is set to be larger than the additional water supply amount, if the detected water pressure is higher than the reference water pressure, it is possible to minimize an increase in number of times of the additional water supply when the detected water pressure is low. As described above, if the increase in number of times of the additional water supply is minimized, water may be prevented from being phase-changed into ice during the water supply process.

After supplying the water by the additional water supply amount, the controller 800 controls the driver 480 to allow the second tray 380 to move to the ice making position (S3). For example, the controller 800 may control the driver 480 to allow the second tray 380 to move from the water supply position in the reverse direction.

After the second tray 380 moves to the ice making position, the controller 800 may determine whether the water supply amount of the ice making cell 320*a* reaches a target water supply amount (S15).

As a result of the determination in operation S15, when it is determined that the water supply amount of the ice-making cell 320*a* reaches the target water supply amount, the controller 800 starts the ice making (S16).

On the other hand, as a result of determination in operation S15, if the water supply amount of the ice making cell 320*a* does not reach the target water supply amount, the controller 800 performs the additional water supply again.

That is, in this embodiment, after the first water supply, the additional water supply may be repetitively performed until the water supply amount to the ice making cell reaches the target water supply amount. In this specification, the first water supply process may be used as a basic water supply process. Then, this embodiment may include a basic water supply process and one or more additional water supply processes.

Although not limited, the reference water supply amount may be set to 80% or more of the target water supply amount. The additional water supply amount may be set to less than 20% of the target water supply amount. While the number of additional water supply decreases as the amount of additional water supply increases, there is a high possibility that the actual water supply amount exceeds the target water supply amount after the additional water supply.

On the other hand, as the additional water supply decreases, the water supply may be precisely adjusted, whereas the number of additional water supply may increase.

In this embodiment, in order to minimize the increase in number of additional water supply while the actual water supply amount does not exceed the target water supply amount, the additional water supply amount may be set within a range of 1% to 10% of the target water supply amount.

In the state in which the second tray 380 moves to the ice making position, ice making is started (S16).

For example, the ice making may be started when the second tray 380 reaches the ice making position. Alternatively, when the second tray 380 reaches the ice making position, and the predetermined time elapses after the water supply is completed, the ice making may be started.

When ice making is started, the controller 800 may control the cold air supply part 900 to supply cold air to the ice making cell 320*a*.

After the ice making is started, the controller 800 may control the transparent ice heater 430 to be turned on in at least partial sections of the cold air supply part 900 supplying the cold air to the ice making cell 320*a*.

When the transparent ice heater 430 is turned on, since the heat of the transparent ice heater 430 is transferred to the ice making cell 320*a*, the ice making rate of the ice making cell 320*a* may be delayed.

According to this embodiment, the ice making rate may be delayed so that the bubbles dissolved in the water inside the ice making cell 320*a* move from the portion at which ice is made toward the liquid water by the heat of the transparent ice heater 430 to make the transparent ice in the ice maker 200.

In the ice making process, the controller 800 may determine whether the turn-on condition of the transparent ice heater 430 is satisfied (S17).

In this embodiment, the transparent ice heater 430 is not turned on immediately after the ice making is started, and the transparent ice heater 430 may be turned on only when the turn-on condition of the transparent ice heater 430 is satisfied (S18).

Generally, the water supplied to the ice making cell 320*a* may be water having normal temperature or water having a temperature lower than the normal temperature. The temperature of the water supplied is higher than a freezing point of water. Thus, after the water supply, the temperature of the water is lowered by the cold air, and when the temperature of the water reaches the freezing point of the water, the water is changed into ice.

In this embodiment, the transparent ice heater 430 may not be turned on until the water is phase-changed into ice.

If the transparent ice heater 430 is turned on before the temperature of the water supplied to the ice making cell 320*a* reaches the freezing point, the speed at which the temperature of the water reaches the freezing point by the heat of the transparent ice heater 430 is slow. As a result, the starting of the ice making may be delayed.

The transparency of the ice may vary depending on the presence of the air bubbles in the portion at which ice is made after the ice making is started. If heat is supplied to the ice making cell 320*a* before the ice is made, the transparent ice heater 430 may operate regardless of the transparency of the ice.

Thus, according to this embodiment, after the turn-on condition of the transparent ice heater 430 is satisfied, when the transparent ice heater 430 is turned on, power consumption due to the unnecessary operation of the transparent ice heater 430 may be prevented.

Alternatively, even if the transparent ice heater 430 is turned on immediately after the start of ice making, since the transparency is not affected, it is also possible to turn on the transparent ice heater 430 after the start of the ice making.

In this embodiment, the controller 800 may determine that the turn-on condition of the transparent ice heater 430 is satisfied when a predetermined time elapses from the set specific time point. The specific time point may be set to at least one of the time points before the transparent ice heater 430 is turned on. For example, the specific time point may be set to a time point at which the cold air supply part 900 starts to supply cooling power for the ice making, a time point at which the second tray 380 reaches the ice making position, a time point at which the water supply is completed, and the like.

Alternatively, the controller 800 determines that the turn-on condition of the transparent ice heater 430 is satisfied when a temperature detected by the second temperature sensor 700 reaches a turn-on reference temperature.

For example, the turn-on reference temperature may be a temperature for determining that water starts to freeze at the uppermost side (opening-side) of the ice making cell 320*a*. When a portion of the water is frozen in the ice making cell 320*a*, the temperature of the ice in the ice making cell 320*a* is below zero.

The temperature of the first tray 320 may be higher than the temperature of the ice in the ice making cell 320*a*.

Alternatively, although water exists in the ice making cell 320*a*, after the ice starts to be made in the ice making cell 320*a*, the temperature detected by the second temperature sensor 700 may be below zero.

Thus, to determine that making of ice is started in the ice making cell 320*a* on the basis of the temperature detected by the second temperature sensor 700, the turn-on reference temperature may be set to the below-zero temperature.

That is, when the temperature sensed by the second temperature sensor 700 reaches the turn-on reference temperature, since the turn-on reference temperature is below zero, the ice temperature of the ice making cell 320*a* is below zero, i.e., lower than the below reference temperature. Therefore, it may be indirectly determined that ice is made in the ice making cell 320*a*.

As described above, when the transparent ice heater 430 is not used, the heat of the transparent ice heater 430 is transferred into the ice making cell 320*a*.

In this embodiment, when the second tray 380 is disposed below the first tray 320, the transparent ice heater 430 is disposed to supply the heat to the second tray 380, the ice may be made from an upper side of the ice making cell 320*a*.

In this embodiment, since ice is made from the upper side in the ice making cell 320*a*, the bubbles move downward from the portion at which the ice is made in the ice making cell 320*a* toward the liquid water.

Since density of water is greater than that of ice, water or bubbles may be convex in the ice making cell 320*a*, and the bubbles may move to the transparent ice heater 430.

In this embodiment, the mass (or volume) per unit height of water in the ice making cell 320*a* may be the same or different according to the shape of the ice making cell 320*a*.

For example, when the ice making cell 320*a* is a rectangular parallelepiped, the mass (or volume) per unit height of water in the ice making cell 320*a* is the same. On the other hand, when the ice making cell 320*a* has a shape such as a sphere, an inverted triangle, a crescent moon, etc., the mass (or volume) per unit height of water is different.

When the cooling power of the cold air supply part 900 is constant, if the heating amount of the transparent ice heater 430 is the same, since the mass per unit height of water in the ice making cell 320*a* is different, an ice making rate per unit height may be different.

For example, if the mass per unit height of water is small, the ice making rate is high, whereas if the mass per unit height of water is high, the ice making rate is slow.

As a result, the ice making rate per unit height of water is not constant, and thus, the transparency of the ice may vary according to the unit height. In particular, when ice is made at a high rate, the bubbles may not move from the ice to the water, and the ice may contain the bubbles to lower the transparency.

That is, the more the variation in ice making rate per unit height of water decreases, the more the variation in transparency per unit height of made ice may decrease.

Therefore, in this embodiment, the controller 800 may control the cooling power and/or the heating amount so that the cooling power of the cold air supply part 900 and/or the heating amount of the transparent ice heater 430 is variable according to the mass per unit height of the water of the ice making cell 320*a* (S19).

In this specification, the variable of the cooling power of the cold air supply part 900 may include one or more of a variable output of the compressor, a variable output of the fan, and a variable opening degree of the refrigerant valve.

Also, in this specification, the variation in the heating amount of the transparent ice heater 430 may represent varying the output of the transparent ice heater 430 or varying the duty of the transparent ice heater 430.

In this case, the duty of the transparent ice heater 430 represents a ratio of the turn-on time and the turn-off time of the transparent ice heater 430 in one cycle, or a ratio of the turn-on time and the turn-off time of the transparent ice heater 430 in one cycle.

In this specification, a reference of the unit height of water in the ice making cell 320*a* may vary according to a relative position of the ice making cell 320*a* and the transparent ice heater 430.

For example, as shown in FIG. 16, view (a), the transparent ice heater 430 at the bottom surface of the ice making cell 320*a* may be disposed to have the same height. In this case, a line connecting the transparent ice heater 430 is a horizontal line, and a line extending in a direction perpendicular to the horizontal line serves as a reference for the unit height of the water of the ice making cell 320*a*.

In the case of FIG. 16, view (a), ice is made from the uppermost side of the ice making cell 320*a* and then is grown. On the other hand, as shown in FIG. 16, view (b), the transparent ice heater 430 at the bottom surface of the ice making cell 320*a* may be disposed to have different heights.

In this case, since heat is supplied to the ice making cell 320*a* at different heights of the ice making cell 320*a*, ice is made with a pattern different from that of FIG. 16, view (a).

For example, in FIG. 16, view (b), ice may be made at a position spaced apart from the uppermost end to the left side of the ice making cell 320*a*, and the ice may be grown to a right lower side at which the transparent ice heater 430 is disposed.

Accordingly, in FIG. 16, view (b), a line (reference line) perpendicular to the line connecting two points of the transparent ice heater 430 serves as a reference for the unit height of water of the ice making cell 320*a*. The reference line of FIG. 16, view (b) is inclined at a predetermined angle from the vertical line.

FIG. 17 illustrates a unit height division of water and an output amount of transparent ice heater per unit height when the transparent ice heater is disposed as shown in FIG. 16, view (a).

Hereinafter, an example of controlling an output of the transparent ice heater so that the ice making rate is constant for each unit height of water will be described.

Referring to FIG. 17, when the ice making cell 320*a* is formed, for example, in a spherical shape, the mass per unit height of water in the ice making cell 320*a* increases from the upper side to the lower side to reach the maximum and then decreases again.

For example, the water (or the ice making cell itself) in the spherical ice making cell 320*a* having a diameter of about 50 mm is divided into nine sections (section A to section I) by 6 mm height (unit height). Here, it is noted that there is no limitation on the size of the unit height and the number of divided sections.

When the water in the ice making cell 320*a* is divided into unit heights, the height of each section to be divided is equal to the section A to the section H, and the section I is lower than the remaining sections. Alternatively, the unit heights of all divided sections may be the same depending on the diameter of the ice making cell 320*a* and the number of divided sections, Among the many sections, the section E is a section in which the mass of unit height of water is maximum. For example, in the section in which the mass per unit height of water is maximum, when the ice making cell 320*a* has spherical shape, a diameter of the ice making cell 320*a*, a horizontal cross-sectional area of the ice making cell 320*a*, or a circumference of the ice may be maximum.

As described above, when assuming that the cooling power of the cold air supply part 900 is constant, and the output of the transparent ice heater 430 is constant, the ice making rate in section E is the lowest, the ice making rate in the sections A and I is the fastest.

In this case, since the ice making rate varies for the height, the transparency of the ice may vary for the height. In a specific section, the ice making rate may be too fast to contain bubbles, thereby lowering the transparency.

Therefore, in this embodiment, the output of the transparent ice heater 430 may be controlled so that the ice making rate for each unit height is the same or similar while the bubbles move from the portion at which ice is made to the water in the ice making process.

Specifically, since the mass of the section E is the largest, the output W5 of the transparent ice heater 430 in the section E may be set to a minimum value. Since the volume of the section D is less than that of the section E, the volume of the ice may be reduced as the volume decreases, and thus it is necessary to delay the ice making rate. Thus, an output W6 of the transparent ice heater 430 in the section D may be set to a value greater than an output W5 of the transparent ice heater 430 in the section E.

Since the volume in the section C is less than that in the section D by the same reason, an output W3 of the transparent ice heater 430 in the section C may be set to a value greater than the output W4 of the transparent ice heater 430 in the section D. Since the volume in the section B is less than that in the section C, an output W2 of the transparent ice heater 430 in the section B may be set to a value greater than the output W3 of the transparent ice heater 430 in the section C. Since the volume in the section A is less than that in the section B, an output W1 of the transparent ice heater 430 in the section A may be set to a value greater than the output W2 of the transparent ice heater 430 in the section B.

For the same reason, since the mass per unit height decreases toward the lower side in the section E, the output of the transparent ice heater 430 may increase as the lower side in the section E (see W6, W7, W8, and W9).

Thus, according to an output variation pattern of the transparent ice heater 430, the output of the transparent ice heater 430 is gradually reduced from the first section to the intermediate section after the transparent ice heater 430 is initially turned on.

The output of the transparent ice heater 430 may be minimum in the intermediate section in which the mass of unit height of water is maximum. The output of the transparent ice heater 430 may again increase step by step from the next section of the intermediate section.

The output of the transparent ice heater 430 in two adjacent sections may be set to be the same according to the type or mass of the made ice. For example, the output of section C and section D may be the same. That is, the output of the transparent ice heater 430 may be the same in at least two sections.

Alternatively, the output of the transparent ice heater 430 may be set to the minimum in sections other than the section in which the mass per unit height is the smallest. For example, the output of the transparent ice heater 430 in the section D or the section F may be minimum. The output of the transparent ice heater 430 in the section E may be equal to or greater than the minimum output.

In summary, in this embodiment, the output of the transparent ice heater 430 may have a maximum initial output. In the ice making process, the output of the transparent ice heater 430 may be reduced to the minimum output of the transparent ice heater 430.

The output of the transparent ice heater 430 may be gradually reduced in each section, or the output may be maintained in at least two sections.

The output of the transparent ice heater 430 may increase from the minimum output to the end output. The end output may be the same as or different from the initial output.

In addition, the output of the transparent ice heater 430 may incrementally increase in each section from the minimum output to the end output, or the output may be maintained in at least two sections.

Alternatively, the output of the transparent ice heater 430 may be an end output in a section before the last section among a plurality of sections. In this case, the output of the transparent ice heater 430 may be maintained as an end output in the last section. That is, after the output of the transparent ice heater 430 becomes the end output, the end output may be maintained until the last section.

As the ice making is performed, an amount of ice existing in the ice making cell 320*a* may decrease. Thus, when the transparent ice heater 430 continues to increase until the output reaches the last section, the heat supplied to the ice making cell 320*a* may be reduced. As a result, excessive water may exist in the ice making cell 320*a* even after the end of the last section.

Therefore, the output of the transparent ice heater 430 may be maintained as the end output in at least two sections including the last section.

The transparency of the ice may be uniform for each unit height, and the bubbles may be collected in the lowermost section by the output control of the transparent ice heater 430. Thus, when viewed on the ice as a whole, the bubbles may be collected in the localized portion, and the remaining portion may become totally transparent.

As described above, even if the ice making cell 320*a* does not have the spherical shape, the transparent ice may be made when the output of the transparent ice heater 430 varies according to the mass for each unit height of water in the ice making cell 320*a*.

The heating amount of the transparent ice heater 430 when the mass for each unit height of water is large may be less than that of the transparent ice heater 430 when the mass for each unit height of water is small.

For example, while maintaining the same cooling power of the cold air supply part 900, the heating amount of the transparent ice heater 430 may vary so as to be inversely proportional to the mass per unit height of water.

Also, it is possible to make the transparent ice by varying the cooling power of the cold air supply part 900 according to the mass per unit height of water.

For example, when the mass per unit height of water is large, the cold force of the cold air supply part 900 may increase, and when the mass per unit height is small, the cold force of the cold air supply part 900 may decrease.

For example, while maintaining a constant heating amount of the transparent ice heater 430, the cooling power of the cold air supply part 900 may vary to be proportional to the mass per unit height of water.

Referring to the variable cooling power pattern of the cold air supply part 900 in the case of making the spherical ice, the cooling power of the cold air supply part 900 from the initial section to the intermediate section during the ice making process may gradually increase.

The cooling power of the cold air supply part 900 may be maximum in the intermediate section in which the mass per unit height of water is maximum. The cooling power of the cold air supply part 900 may be gradually reduced again from the next section of the intermediate section.

Alternatively, the transparent ice may be made by varying the cooling power of the cold air supply part 900 and the heating amount of the transparent ice heater 430 according to the mass for each unit height of water.

For example, the heating power of the transparent ice heater 430 may vary so that the cooling power of the cold air supply part 900 is proportional to the mass per unit height of water. The heating power may be inversely proportional to the mass per unit height of water.

According to this embodiment, when one or more of the cooling power of the cold air supply part 900 and the heating amount of the transparent ice heater 430 are controlled according to the mass per unit height of water, the ice making rate per unit height of water may be substantially the same or may be maintained within a predetermined range.

The controller 800 may determine whether the ice making is completed based on the temperature sensed by the second temperature sensor 700 (S20).

When it is determined that the ice making is completed, the controller 800 may turn off the transparent ice heater 430 (S21).

For example, when the temperature sensed by the second temperature sensor 700 reaches a first reference temperature, the controller 800 may determine that the ice making is completed to turn off the transparent ice heater 430.

In this case, since a distance between the second temperature sensor 700 and each ice making cell 320*a* is different, in order to determine that the ice making is completed in all the ice making cells 320*a*, the controller 800 may perform the ice separation after a certain amount of time, at which it is determined that ice making is completed, has passed or when the temperature sensed by the second temperature sensor 700 reaches a second reference temperature lower than the first reference temperature.

When the ice making is completed, the controller 800 operates one or more of the ice separation heater 290 and the transparent ice heater 430 (S22).

When at least one of the ice separation heater 290 or the transparent ice heater 430 is turned on, heat of the heater is transferred to at least one of the first tray 320 or the second tray 380 so that the ice may be separated from the surfaces (inner surfaces) of one or more of the first tray 320 and the second tray 380.

Also, the heat of the heaters 290 and 430 is transferred to the contact surface of the first tray 320 and the second tray 380, and thus, the first contact surface 322*c* of the first tray 320 and the second contact surface 382*c* of the second tray 380 may be in a state capable of being separated from each other.

When at least one of the ice separation heater 290 and the transparent ice heater 430 operate for a predetermined time, or when the temperature sensed by the second temperature sensor 700 is equal to or higher than an off reference temperature, the controller 800 is turned off the heaters 290 and 430, which are turned on. Although not limited, the turn-off reference temperature may be set to above zero temperature.

The controller 800 operates the driver 480 to allow the second tray 380 to move in the forward direction (S23).

As illustrated in FIG. 21, when the second tray 380 move in the forward direction, the second tray 380 is spaced apart from the first tray 20.

The moving force of the second tray 380 is transmitted to the first pusher 260 by the pusher link 500. Then, the first pusher 260 descends along the guide slot 302, and the pushing bar 264 passes through the opening 324 to press the ice in the ice making cell 320*a*.

In this embodiment, ice may be separated from the first tray 320 before the pushing bar 264 presses the ice in the ice making process. That is, ice may be separated from the surface of the first tray 320 by the heater that is turned on. In this case, the ice may move together with the second tray 380 while the ice is supported by the second tray 380.

For another example, even when the heat of the heater is applied to the first tray 320, the ice may not be separated from the surface of the first tray 320.

Therefore, when the second tray 380 moves in the forward direction, there is possibility that the ice is separated from the second tray 380 in a state in which the ice contacts the first tray 320.

In this state, in the process of moving the second tray 380, the pushing bar 264 passing through the opening 324 of the first tray 320 may press the ice contacting the first tray 320, and thus, the ice may be separated from the tray 320. The ice separated from the first tray 320 may be supported by the second tray 380 again.

When the ice moves together with the second tray 380 while the ice is supported by the second tray 380, the ice may be separated from the tray 250 by its own weight even if no external force is applied to the second tray 380.

While the second tray 380 moves, even if the ice does not fall from the second tray 380 by its own weight, when the second pusher 540 presses the second tray 540 as illustrated in FIG. 22, the ice may be separated from the second tray 380 to fall downward.

For example, as illustrated in FIG. 22, while the second tray 380 moves in the forward direction, the second tray 380 may contact the pushing bar 544 of the second pusher 540.

When the second tray 380 continuously moves in the forward direction, the pushing bar 544 may press the second tray 380 to deform the second tray 380. Thus, the pressing force of the pushing bar 544 may be transferred to the ice so that the ice is separated from the surface of the second tray 380. The ice separated from the surface of the second tray 380 may drop downward and be stored in the ice bin 600.

In this embodiment, as shown in FIG. 22, the position at which the second tray 380 is pressed by the second pusher 540 and deformed may be referred to as an ice separation position.

Whether the ice bin 600 is full may be detected while the second tray 380 moves from the ice making position to the ice separation position.

For example, the full ice detection lever 520 rotates together with the second tray 380, and the rotation of the full ice detection lever 520 is interrupted by ice while the full ice detection lever 520 rotates. In this case, it may be determined that the ice bin 600 is in a full ice state. On the other hand, if the rotation of the full ice detection lever 520 is not interfered with the ice while the full ice detection lever 520 rotates, it may be determined that the ice bin 600 is not in the full ice state.

After the ice is separated from the second tray 380, the controller 800 controls the driver 480 to allow the second tray 380 to move in the reverse direction (S24). Then, the second tray assembly 211 moves from the ice separation position to the water supply position.

When the second tray 380 moves to the water supply position of FIG. 18, the controller 800 stops the driver 480.

When the second tray 380 is spaced apart from the pushing bar 544 while the second tray 380 moves in the reverse direction, the deformed second tray 380 may be restored to its original shape.

In the reverse movement of the second tray 380, the moving force of the second tray 380 is transmitted to the first pusher 260 by the pusher link 500, and thus, the first pusher 260 ascends, and the pushing bar 264 is removed from the ice making cell 320*a*.

Figure 23:
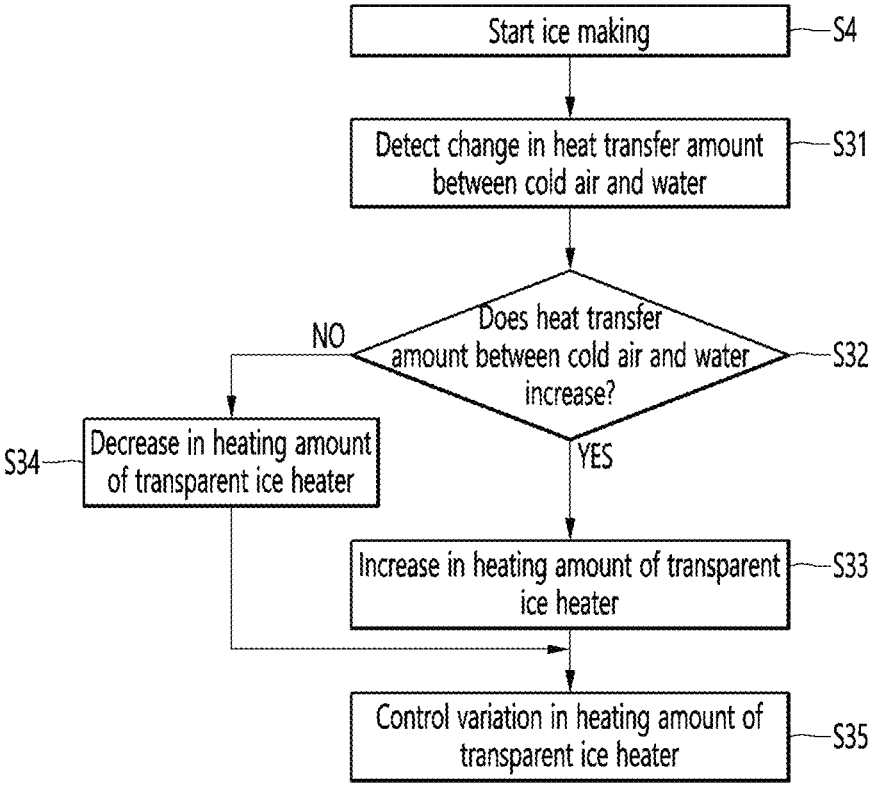
FIG. 23 is a view for explaining a method for controlling a refrigerator when a heat transfer amount between cold air and water vary in an ice making process.

FIG. 23 is a view for explaining a method for controlling the refrigerator when a heat transfer amount between cold air and water vary in the ice making process.

Referring to FIG. 23, cooling power of the cold air supply part 900 may be determined corresponding to the target temperature of the freezing compartment 32. The cold air generated by the cold air supply part 900 may be supplied to the freezing chamber 32.

The water of the ice making cell 320*a* may be phase-changed into ice by heat transfer between the cold water supplied to the freezing chamber 32 and the water of the ice making cell 320*a*.

In this embodiment, a heating amount of the transparent ice heater 430 for each unit height of water may be determined in consideration of predetermined cooling power of the cold air supply part 900.

In this embodiment, the heating amount of the transparent ice heater 430 determined in consideration of the predetermined cooling power of the cold air supply part 900 is referred to as a reference heating amount. The magnitude of the reference heating amount per unit height of water is different.

However, when the amount of heat transfer between the cold of the freezing compartment 32 and the water in the ice making cell 320*a* is variable, if the heating amount of the transparent ice heater 430 is not adjusted to reflect this, the transparency of ice for each unit height varies.

In this embodiment, the case in which the heat transfer amount between the cold and the water increase may be a case in which the cooling power of the cold air supply part 900 increases or a case in which the air having a temperature lower than the temperature of the cold air in the freezing compartment 32 is supplied to the freezing compartment 32.

On the other hand, the case in which the heat transfer amount between the cold and the water decrease may be a case in which the cooling power of the cold air supply part 900 decreases or a case in which the air having a temperature higher than the temperature of the cold air in the freezing compartment 32 is supplied to the freezing compartment 32.

For example, a target temperature of the freezing compartment 32 is lowered, an operation mode of the freezing compartment 32 is changed from a normal mode to a rapid cooling mode, an output of at least one of the compressor or the fan increases, or an opening degree increases, the cooling power of the cold air supply part 900 may increase.

On the other hand, the target temperature of the freezer compartment 32 increases, the operation mode of the freezing compartment 32 is changed from the rapid cooling mode to the normal mode, the output of at least one of the compressor or the fan decreases, or the opening degree of the refrigerant valve decreases, the cooling power of the cold air supply part 900 may decrease.

When the cooling power of the cold air supply part 900 increases, the temperature of the cold air around the ice maker 200 is lowered to increase in ice making rate.

On the other hand, if the cooling power of the cold air supply part 900 decreases, the temperature of the cold air around the ice maker 200 increases, the ice making rate decreases, and also, the ice making time increases.

Therefore, in this embodiment, when the amount of heat transfer of cold and water increases so that the ice making rate is maintained within a predetermined range lower than the ice making rate when the ice making is performed with the transparent ice heater 430 that is turned off, the heating amount of transparent ice heater 430 may be controlled to increase.

On the other hand, when the amount of heat transfer between the cold and the water decreases, the heating amount of transparent ice heater 430 may be controlled to decrease.

In this embodiment, when the ice making rate is maintained within the predetermined range, the ice making rate is less than the rate at which the bubbles move in the portion at which the ice is made, and no bubbles exist in the portion at which the ice is made.

When the cooling power of the cold air supply part 900 increases, the heating amount of transparent ice heater 430 may increase. On the other hand, when the cooling power of the cold air supply part 900 decreases, the heating amount of transparent ice heater 430 may decrease.

Hereinafter, the case in which the target temperature of the freezing compartment 32 varies will be described with an example.

The controller 800 may control the output of the transparent ice heater 430 so that the ice making rate may be maintained within the predetermined range regardless of the target temperature of the freezing compartment 32.

For example, the ice making may be started (S4), and a change in heat transfer amount of cold and water may be detected (S31).

For example, it may be sensed that the target temperature of the freezing compartment 32 is changed through an input part (not shown).

The controller 800 may determine whether the heat transfer amount of cold and water increases (S32). For example, the controller 800 may determine whether the target temperature increases.

As the result of the determination in the process (S32), when the target temperature increases, the controller 800 may decrease the reference heating amount of transparent ice heater 430 that is predetermined in each of the current section and the remaining sections.

The variable control of the heating amount of the transparent ice heater 430 may be normally performed until the ice making is completed (S35).

On the other hand, if the target temperature decreases, the controller 800 may increase the reference heating amount of transparent ice heater 430 that is predetermined in each of the current section and the remaining sections. The variable control of the heating amount of the transparent ice heater 430 may be normally performed until the ice making is completed (S35).

On the other hand, if the target temperature of freezing compartment 32 decreases, the controller 800 may increase the reference heating amount of transparent ice heater 430 that is predetermined in each of the current section and the remaining sections. The variable control of the heating amount of the transparent ice heater 430 may be normally performed until the ice making is completed (S35).

In this embodiment, the reference heating mount that increases or decreases may be predetermined and then stored in a memory.

According to this embodiment, the controller 800 may control the output of the heater 430 so that the output of the transparent ice heater 430 when the target temperature of the freezing compartment is lower is high compared to the output of the transparent ice heater when the target temperature of the freezing compartment is high.

According to this embodiment, the reference heating amount for each section of the transparent ice heater increases or decreases in response to the change in the heat transfer amount of cold and water, and thus, the ice making rate may be maintained within the predetermined range, thereby realizing the uniform transparency for each unit height of the ice.

The invention claimed is:

1. A refrigerator comprising:

a storage chamber;

a cooler configured to perform at least one of supplying cold or absorbing heat; and an ice maker comprising:

a first tray configured to define a first portion of a cell;

a second tray configured to define a second portion of the cell, the first and second portions configured to form a space in which liquid introduced into the space is phase-changed to ice;

a driver configured to move the second tray relative to the first tray to a first position, a second position, and a third position;

a liquid supply configured to supply the liquid;

a supply valve configured to adjust a flow of the liquid supplied to the space of the cell;

a temperature sensor provided to detect a temperature of the first tray or a temperature of the liquid or the ice in the cell and configured to detect a supply amount of the liquid in the space of the cell; and a controller configured to control the supply valve and the driver such that:

when the second tray is moved to the second position such that the first and second portions are spaced apart from each other, the supply valve is controlled such that a reference supply amount is supplied to the space of the cell, after supplying the reference supply amount is completed, the second tray is moved to the first position such that the second portion is in contact with the first portion, when the controller determines, based on the temperature sensor detecting the temperature of the first tray or the temperature of the liquid or the ice in the cell, that the reference supply amount reaches a target supply amount at the first position, and an ice making process begins, when the controller determines that the reference supply amount has not reached the target water supply amount, the second tray is moved again from the first position to the second position and the supply valve is controlled to supply an additional supply amount less than the reference supply amount, and the reference supply amount is set differently according to a liquid pressure determined when the liquid is supplied to the space of the cell, wherein the controller determines that the reference supply amount reaches the target supply amount when the temperature detected by the temperature sensor reaches a predetermined temperature that is above zero, wherein the temperature sensor is exposed to the cell, the first portion and the second portion are arranged in one direction, and the temperature sensor overlaps the cell in the one direction, and wherein the ice maker further comprises a heater configured to provide heat to the first portion, a lowermost end of the temperature sensor is positioned lower than an upper end of the cell, and the lowermost end of the temperature sensor is positioned higher than a lowermost end of the heater.

2. The refrigerator of claim 1, wherein, when a predetermined time elapses after the supply valve is controlled to begin liquid supply, the controller determines whether the liquid pressure is less than a predetermined liquid pressure, and wherein, when the liquid pressure is equal to or greater than the predetermined liquid pressure, the reference supply amount is set as a first reference supply amount, and when the liquid pressure is less than the predetermined liquid pressure, the reference supply amount is set as a second reference supply amount less than the first reference supply amount.

3. The refrigerator of claim 2, wherein, when the liquid pressure is equal to or greater than the predetermined liquid pressure, the controller closes the supply valve when the supply amount reaches the first reference supply amount, and when the liquid pressure is less than the predetermined liquid pressure, the controller closes the supply valve when the supply amount reaches the second reference supply amount.

4. The refrigerator of claim 2, wherein the additional supply amount is set differently according to the liquid pressure.

5. The refrigerator of claim 4, wherein the additional supply amount when the liquid pressure is a first liquid pressure is greater than the additional supply amount when the liquid pressure is a second liquid pressure, the second liquid pressure being greater than the first liquid pressure.

6. The refrigerator of claim 1, wherein, after a supply of the additional supply amount is completed, the controller controls the second tray to move to the first position and determines, via the temperature sensor, whether the supply amount reaches the target supply amount.

7. The refrigerator of claim 6, wherein, when the supply amount reaches the target supply amount, the controller controls the ice making process to start, and when the supply amount has not reached the target supply amount, the supply of the additional supply amount is repetitively performed until the supply amount reaches the target water supply amount.

8. The refrigerator of claim 1, wherein, after the ice making process is completed, the controller controls the second tray to move in a first direction to the third position and then, after ice is removed, move the second tray in a second direction opposite to the first direction to the second position.

9. The refrigerator of claim 1, wherein, after the second tray moves to the second position after the ice is removed, the controller controls the supply valve so that as much as the reference supply amount is supplied to the space of the cell when a temperature detected by the temperature sensor reaches a supply start temperature.

10. The refrigerator of claim 1, wherein, after the second tray moves to the second position, the controller controls the supply valve so that as much as the additional supply amount is supplied to the space of the cell when a temperature detected by the temperature sensor reaches a supply start temperature.

11. The refrigerator of claim 1, wherein the controller determines whether an ice making is completed based on the temperature sensed by the temperature sensor.

12. The refrigerator of claim 1, further comprising first and second heaters configured to provide heat to the cell, wherein the controller controls the second heater to be turned on in at least a partial section during the ice making process so that air bubbles dissolved in the liquid within cell move away from where ice is being generated toward liquid still in a liquid state, and wherein the controller controls the first heater to be turned on in an ice separation process.

13. The refrigerator according to claim 12, wherein the controller controls at least one of a cooling power of the cooler or a heating amount of the second heater to vary according to a mass per unit height of liquid within the space of the cell.

14. The refrigerator of claim 1, wherein the ice maker further comprises a heater case on which the heater is mounted and in contact with the first portion.

15. The refrigerator of claim 12, wherein the ice maker further comprises a first heater case on which the first heater is mounted.

16. The refrigerator of claim 12, wherein the ice maker further comprises a second heater case on which the second heater is mounted.

* * * * *